US010526852B2

(12) United States Patent
Wiens

(10) Patent No.: US 10,526,852 B2
(45) Date of Patent: Jan. 7, 2020

(54) COMBINED MULTI-COUPLER WITH LOCKING CLAMP CONNECTION FOR TOP DRIVE

(71) Applicant: Weatherford Technology Holdings, LLC, Houston, TX (US)

(72) Inventor: Jimmy Duane Wiens, Willis, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 198 days.

(21) Appl. No.: 15/627,428

(22) Filed: Jun. 19, 2017

(65) Prior Publication Data

US 2018/0363388 A1 Dec. 20, 2018

(51) Int. Cl.

| | |
|---|---|
| ***E21B 17/046*** | (2006.01) |
| ***E21B 17/043*** | (2006.01) |
| ***E21B 17/03*** | (2006.01) |
| ***E21B 17/02*** | (2006.01) |

(52) U.S. Cl.

CPC ..... *E21B 17/043* (2013.01); *E21B 17/023* (2013.01); *E21B 17/03* (2013.01); *E21B 17/046* (2013.01)

(58) Field of Classification Search

CPC ..... E21B 19/16; E21B 19/06; E21B 19/07; E21B 17/02; E21B 17/046; E21B 19/08

See application file for complete search history.

(56) References Cited

U.S. PATENT DOCUMENTS

| | | | | |
|---|---|---|---|---|
| 1,367,156 A | | 2/1921 | McAlvay et al. | |
| 1,610,977 A | | 12/1926 | Scott | |
| 1,822,444 A | | 9/1931 | MacClatchie | |
| 1,853,299 A | | 4/1932 | Carroll | |
| 2,370,354 A | | 2/1945 | Hurst | |
| 2,863,638 A | * | 12/1958 | Thornburg | E21B 3/02 173/197 |
| 3,147,992 A | | 9/1964 | Haeber et al. | |
| 3,354,951 A | | 11/1967 | Savage et al. | |
| 3,385,370 A | | 5/1968 | Knox et al. | |
| 3,662,842 A | | 5/1972 | Bromell | |
| 3,698,426 A | | 10/1972 | Litchfield et al. | |
| 3,747,675 A | | 7/1973 | Brown | |
| 3,766,991 A | | 10/1973 | Brown | |

(Continued)

FOREIGN PATENT DOCUMENTS

| | | |
|---|---|---|
| AU | 2012201644 A1 | 4/2012 |
| AU | 2013205714 A1 | 5/2013 |

(Continued)

OTHER PUBLICATIONS

Canadian Office Action in related application CA 2,955,754 dated Jul. 17, 2018.

(Continued)

*Primary Examiner* — Kipp C Wallace

(74) *Attorney, Agent, or Firm* — Patterson + Sheridan, LLP

(57) ABSTRACT

In one embodiment, a coupling system for a top drive and a tool includes a drive stem of the top drive configured to transfer torque to the tool, a key disposed on the drive stem and movable to an extended position, an adapter of the tool configured to receive the drive stem, a key recess disposed on the adapter and configured to receive the key in the extended position, and a biasing member configured to bias the key towards the extended position.

20 Claims, 28 Drawing Sheets

(56) References Cited

U.S. PATENT DOCUMENTS 3,774,697 A 11/1973 Brown
3,776,320 A 12/1973 Brown
3,808,916 A * 5/1974 Porter ..... E21B 3/02 175/320
3,842,619 A 10/1974 Bychurch, Sr.
3,888,318 A 6/1975 Brown
3,899,024 A 8/1975 Tonnelli et al.
3,913,687 A 10/1975 Gyongyosi et al.
3,915,244 A 10/1975 Brown
3,964,552 A 6/1976 Slator
4,022,284 A 5/1977 Crow
4,051,587 A 10/1977 Boyadjieff
4,100,968 A 7/1978 Delano
4,192,155 A 3/1980 Gray
4,199,847 A 4/1980 Owens
4,235,469 A 11/1980 Denny et al.
4,364,407 A 12/1982 Hilliard
4,377,179 A 3/1983 Giebeler
4,402,239 A 9/1983 Mooney
4,406,324 A 9/1983 Baugh et al.
4,422,794 A * 12/1983 Deken ..... E21B 17/046 292/128
4,449,596 A 5/1984 Boyadjieff
4,478,244 A 10/1984 Garrett
4,497,224 A 2/1985 Jürgens
4,593,773 A 6/1986 Skeie
4,762,187 A 8/1988 Haney
4,776,617 A 10/1988 Sato
4,779,688 A 10/1988 Baugh
4,791,997 A 12/1988 Krasnov
4,813,493 A 3/1989 Shaw et al.
4,815,546 A 3/1989 Haney et al.
4,821,814 A 4/1989 Willis et al.
4,844,181 A 7/1989 Bassinger
4,867,236 A 9/1989 Haney et al.
4,955,949 A 9/1990 Bailey et al.
4,962,819 A 10/1990 Bailey et al.
4,972,741 A 11/1990 Sibille
4,981,180 A 1/1991 Price
4,997,042 A 3/1991 Jordan et al.
5,036,927 A 8/1991 Willis
5,099,725 A 3/1992 Bouligny, Jr. et al.
5,152,554 A 10/1992 LaFleur et al.
5,172,940 A 12/1992 Usui et al.
5,191,939 A 3/1993 Stokley
5,215,153 A 6/1993 Younes
5,245,877 A 9/1993 Ruark
5,282,653 A 2/1994 LaFleur et al.
5,297,833 A 3/1994 Willis et al.
5,348,351 A 9/1994 LaFleur et al.
5,385,514 A 1/1995 Dawe
5,433,279 A 7/1995 Tessari et al.
5,441,310 A 8/1995 Barrett et al.
5,456,320 A 10/1995 Baker
5,479,988 A 1/1996 Appleton
5,486,223 A 1/1996 Carden
5,501,280 A 3/1996 Brisco
5,509,442 A 4/1996 Claycomb
5,577,566 A 11/1996 Albright et al.
5,584,343 A 12/1996 Coone
5,645,131 A 7/1997 Trevisani
5,664,310 A 9/1997 Penisson
5,682,952 A 11/1997 Stokley
5,735,348 A 4/1998 Hawkins, III
5,778,742 A 7/1998 Stuart
5,839,330 A 11/1998 Stokka
5,909,768 A 6/1999 Castille et al.
5,918,673 A 7/1999 Hawkins et al.
5,950,724 A 9/1999 Giebeler
5,971,079 A 10/1999 Mullins
5,992,520 A 11/1999 Schultz et al.
6,003,412 A 12/1999 Dlask et al.
6,053,191 A 4/2000 Hussey
6,102,116 A 8/2000 Giovanni
6,142,545 A 11/2000 Penman et al.
6,161,617 A 12/2000 Gjedebo
6,173,777 B1 1/2001 Mullins
6,276,450 B1 8/2001 Seneviratne
6,279,654 B1 8/2001 Mosing et al.
6,289,911 B1 9/2001 Majkovic
6,309,002 B1 10/2001 Bouligny
6,311,792 B1 11/2001 Scott et al.
6,328,343 B1 12/2001 Hosie et al.
6,378,630 B1 4/2002 Ritorto et al.
6,390,190 B2 5/2002 Mullins
6,401,811 B1 6/2002 Coone
6,415,862 B1 7/2002 Mullins
6,431,626 B1 8/2002 Bouligny
6,443,241 B1 9/2002 Juhasz et al.
6,460,620 B1 10/2002 LaFleur
6,527,047 B1 3/2003 Pietras
6,536,520 B1 3/2003 Snider et al.
6,571,876 B2 6/2003 Szarka
6,578,632 B2 6/2003 Mullins
6,591,471 B1 7/2003 Hollingsworth et al.
6,595,288 B2 7/2003 Mosing et al.
6,604,578 B2 8/2003 Mullins
6,622,796 B1 9/2003 Pietras
6,637,526 B2 10/2003 Juhasz et al.
6,640,824 B2 11/2003 Majkovic
6,666,273 B2 12/2003 Laurel
6,675,889 B1 1/2004 Mullins et al.
6,679,333 B2 1/2004 York et al.
6,688,398 B2 2/2004 Pietras
6,691,801 B2 2/2004 Juhasz et al.
6,705,405 B1 3/2004 Pietras
6,715,542 B2 4/2004 Mullins
6,719,046 B2 4/2004 Mullins
6,722,425 B2 4/2004 Mullins
6,725,938 B1 4/2004 Pietras
6,732,819 B2 5/2004 Wenzel
6,732,822 B2 * 5/2004 Slack ..... B25B 5/065 166/138
6,742,584 B1 6/2004 Appleton
6,742,596 B2 6/2004 Haugen
6,779,599 B2 8/2004 Mullins et al.
6,832,656 B2 12/2004 Fournier, Jr. et al.
6,883,605 B2 4/2005 Arceneaux et al.
6,892,835 B2 5/2005 Shahin et al.
6,908,121 B2 6/2005 Hirth et al.
6,925,807 B2 8/2005 Jones et al.
6,938,697 B2 9/2005 Haugen
6,976,298 B1 12/2005 Pietras
6,994,176 B2 2/2006 Shahin et al.
7,000,503 B2 2/2006 Dagenais et al.
7,001,065 B2 2/2006 Dishaw et al.
7,004,259 B2 2/2006 Pietras
7,007,753 B2 3/2006 Robichaux et al.
7,017,671 B2 3/2006 Williford
7,021,374 B2 4/2006 Pietras
7,025,130 B2 4/2006 Bailey et al.
7,073,598 B2 7/2006 Haugen
7,090,021 B2 8/2006 Pietras
7,096,948 B2 8/2006 Mosing et al.
7,114,235 B2 10/2006 Jansch et al.
7,128,161 B2 10/2006 Pietras
7,137,454 B2 11/2006 Pietras
7,140,443 B2 11/2006 Beierbach et al.
7,143,849 B2 12/2006 Shahin et al.
7,147,254 B2 12/2006 Niven et al.
7,159,654 B2 1/2007 Ellison et al.
7,178,612 B2 2/2007 Belik
7,213,656 B2 5/2007 Pietras
7,219,744 B2 5/2007 Pietras
7,231,969 B2 6/2007 Folk et al.
7,270,189 B2 9/2007 Brown et al.
7,281,451 B2 10/2007 Schulze Beckinghausen
7,281,587 B2 10/2007 Haugen
7,303,022 B2 12/2007 Tilton et al.
7,325,610 B2 2/2008 Giroux et al.
7,353,880 B2 4/2008 Pietras
7,448,456 B2 11/2008 Shahin et al.
7,451,826 B2 11/2008 Pietras
7,490,677 B2 2/2009 Buytaert et al.

(56) References Cited

U.S. PATENT DOCUMENTS 7,503,397 B2 3/2009 Giroux et al.
7,509,722 B2 3/2009 Shahin et al.
7,513,300 B2 4/2009 Pietras et al.
7,591,304 B2 9/2009 Juhasz et al.
7,617,866 B2 11/2009 Pietras
7,635,026 B2 12/2009 Mosing et al.
7,665,515 B2 2/2010 Mullins
7,665,530 B2 2/2010 Wells et al.
7,665,531 B2 2/2010 Pietras
7,669,662 B2 3/2010 Pietras
7,690,422 B2 4/2010 Swietlik et al.
7,694,730 B2 4/2010 Angman
7,694,744 B2 4/2010 Shahin
7,699,121 B2 4/2010 Juhasz et al.
7,712,523 B2 5/2010 Snider et al.
7,730,698 B1 6/2010 Montano et al.
7,757,759 B2 7/2010 Jahn et al.
7,779,922 B1 8/2010 Harris et al.
7,793,719 B2 9/2010 Snider et al.
7,817,062 B1 10/2010 Li et al.
7,828,085 B2 11/2010 Kuttel et al.
7,841,415 B2 11/2010 Winter
7,854,265 B2 12/2010 Zimmermann
7,866,390 B2 1/2011 Latiolais, Jr. et al.
7,874,352 B2 1/2011 Odell, II et al.
7,874,361 B2 1/2011 Mosing et al.
7,878,237 B2 2/2011 Angman
7,878,254 B2 2/2011 Abdollahi et al.
7,882,902 B2 2/2011 Boutwell, Jr.
7,896,084 B2 3/2011 Haugen
7,918,273 B2 4/2011 Snider et al.
7,958,787 B2 6/2011 Hunter
7,971,637 B2 7/2011 Duhon et al.
7,975,768 B2 7/2011 Fraser et al.
8,118,106 B2 2/2012 Wiens et al.
8,141,642 B2 3/2012 Olstad et al.
8,210,268 B2 7/2012 Heidecke et al.
8,281,856 B2 10/2012 Jahn et al.
8,307,903 B2 11/2012 Redlinger et al.
8,365,834 B2 2/2013 Liess et al.
8,459,361 B2 6/2013 Leuchtenberg
8,505,984 B2 8/2013 Henderson et al.
8,567,512 B2 10/2013 Odell, II et al.
8,601,910 B2 12/2013 Begnaud
8,636,067 B2 1/2014 Robichaux et al.
8,651,175 B2 2/2014 Fallen
8,668,003 B2 3/2014 Osmundsen et al.
8,708,055 B2 4/2014 Liess et al.
8,727,021 B2 5/2014 Heidecke et al.
8,776,898 B2 7/2014 Liess et al.
8,783,339 B2 7/2014 Sinclair et al.
8,839,884 B2 9/2014 Kuttel et al.
8,893,772 B2 11/2014 Henderson et al.
9,068,406 B2 6/2015 Clasen et al.
9,206,851 B2 12/2015 Slaughter, Jr. et al.
9,528,326 B2 12/2016 Heidecke et al.
9,631,438 B2 4/2017 McKay
10,197,050 B2 2/2019 Robison et al.
2001/0021347 A1 9/2001 Mills
2002/0043403 A1 4/2002 Juhasz et al.
2002/0074132 A1 6/2002 Juhasz et al.
2002/0084069 A1 7/2002 Mosing et al.
2002/0129934 A1 9/2002 Mullins et al.
2002/0170720 A1 11/2002 Haugen
2003/0098150 A1 5/2003 Andreychuk
2003/0107260 A1 6/2003 Ording et al.
2003/0221519 A1 12/2003 Haugen
2004/0003490 A1 1/2004 Shahin et al.
2004/0069497 A1 4/2004 Jones et al.
2004/0216924 A1* 11/2004 Pietras ..... E21B 19/00 175/57
2005/0000691 A1 1/2005 Giroux et al.
2005/0173154 A1 8/2005 Lesko
2005/0206163 A1 9/2005 Guesnon et al.
2005/0257933 A1 11/2005 Pietras
2005/0269072 A1 12/2005 Folk et al.
2005/0269104 A1 12/2005 Folk et al.
2005/0269105 A1 12/2005 Pietras
2005/0274508 A1 12/2005 Folk et al.
2006/0037784 A1 2/2006 Walter et al.
2006/0124353 A1 6/2006 Juhasz et al.
2006/0151181 A1 7/2006 Shahin
2006/0180315 A1 8/2006 Shahin et al.
2007/0030167 A1 2/2007 Li et al.
2007/0044973 A1 3/2007 Fraser et al.
2007/0074588 A1 4/2007 Harata et al.
2007/0074874 A1 4/2007 Richardson
2007/0102992 A1 5/2007 Jager
2007/0131416 A1 6/2007 Odell, II et al.
2007/0140801 A1 6/2007 Kuttel et al.
2007/0144730 A1 6/2007 Shahin et al.
2007/0158076 A1 7/2007 Hollingsworth, Jr. et al.
2007/0251699 A1 11/2007 Wells et al.
2007/0251701 A1 11/2007 Jahn et al.
2007/0257811 A1 11/2007 Hall et al.
2008/0059073 A1 3/2008 Giroux et al.
2008/0093127 A1 4/2008 Angman
2008/0099196 A1 5/2008 Latiolais et al.
2008/0125876 A1 5/2008 Boutwell
2008/0202812 A1 8/2008 Childers et al.
2008/0210063 A1* 9/2008 Slack ..... E21B 19/06 81/420
2008/0308281 A1 12/2008 Boutwell, Jr. et al.
2009/0151934 A1* 6/2009 Heidecke ..... E21B 3/02 166/250.01
2009/0159294 A1 6/2009 Abdollahi et al.
2009/0200038 A1 8/2009 Swietlik et al.
2009/0205820 A1 8/2009 Koederitz et al.
2009/0205827 A1 8/2009 Swietlik et al.
2009/0205836 A1 8/2009 Swietlik et al.
2009/0205837 A1 8/2009 Swietlik et al.
2009/0229837 A1 9/2009 Wiens et al.
2009/0266532 A1 10/2009 Revheim et al.
2009/0272537 A1 11/2009 Alikin et al.
2009/0274544 A1 11/2009 Liess
2009/0274545 A1 11/2009 Liess et al.
2009/0316528 A1 12/2009 Ramshaw et al.
2009/0321086 A1 12/2009 Zimmermann
2010/0032162 A1 2/2010 Olstad et al.
2010/0101805 A1 4/2010 Angelle et al.
2010/0200222 A1 8/2010 Robichaux et al.
2010/0206552 A1 8/2010 Wollum
2010/0206583 A1 8/2010 Swietlik et al.
2010/0206584 A1 8/2010 Clubb et al.
2010/0236777 A1 9/2010 Partouche et al.
2011/0036563 A1* 2/2011 Brække ..... E21B 17/046 166/170
2011/0036586 A1 2/2011 Hart et al.
2011/0039086 A1 2/2011 Graham et al.
2011/0048739 A1* 3/2011 Blair ..... E21B 19/10 166/380
2011/0088495 A1 4/2011 Buck et al.
2011/0214919 A1 9/2011 McClung, III
2011/0280104 A1 11/2011 McClung, III
2012/0048574 A1 3/2012 Wiens et al.
2012/0152530 A1 6/2012 Wiedecke et al.
2012/0153609 A1* 6/2012 McMiles ..... E21B 17/046 285/18
2012/0160517 A1 6/2012 Bouligny et al.
2012/0212326 A1 8/2012 Christiansen et al.
2012/0230841 A1 9/2012 Gregory et al.
2012/0234107 A1 9/2012 Pindiprolu et al.
2012/0273192 A1 11/2012 Schmidt et al.
2012/0298376 A1 11/2012 Twardowski
2013/0055858 A1 3/2013 Richardson
2013/0056977 A1 3/2013 Henderson et al.
2013/0062074 A1 3/2013 Angelle et al.
2013/0075077 A1 3/2013 Henderson et al.
2013/0075106 A1 3/2013 Tran et al.
2013/0105178 A1 5/2013 Pietras
2013/0207382 A1 8/2013 Robichaux
2013/0207388 A1 8/2013 Jansson et al.
2013/0233624 A1 9/2013 In
2013/0269926 A1 10/2013 Liess et al.

(56) References Cited

U.S. PATENT DOCUMENTS

| | | | | |
|---|---|---|---|---|
| 2013/0271576 | A1 | 10/2013 | Elllis | |
| 2013/0275100 | A1 | 10/2013 | Ellis et al. | |
| 2013/0299247 | A1 | 11/2013 | Küttel et al. | |
| 2014/0050522 | A1 | 2/2014 | Slaughter, Jr. et al. | |
| 2014/0090856 | A1 | 4/2014 | Pratt et al. | |
| 2014/0116686 | A1 | 5/2014 | Odell, II et al. | |
| 2014/0131052 | A1 | 5/2014 | Richardson | |
| 2014/0202767 | A1 | 7/2014 | Feasey | |
| 2014/0233804 | A1 | 8/2014 | Gustavsson et al. | |
| 2014/0262521 | A1 | 9/2014 | Bradley et al. | |
| 2014/0305662 | A1 | 10/2014 | Giroux et al. | |
| 2014/0326468 | A1 | 11/2014 | Heidecke et al. | |
| 2014/0352944 | A1 | 12/2014 | Devarajan et al. | |
| 2014/0360780 | A1 | 12/2014 | Moss et al. | |
| 2015/0014063 | A1 | 1/2015 | Simanjuntak et al. | |
| 2015/0053424 | A1 | 2/2015 | Wiens et al. | |
| 2015/0083391 | A1 | 3/2015 | Bangert et al. | |
| 2015/0107385 | A1 | 4/2015 | Mullins et al. | |
| 2015/0218894 | A1* | 8/2015 | Slack | E21B 19/16 166/77.51 |
| 2015/0292307 | A1 | 10/2015 | Best | |
| 2015/0300112 | A1* | 10/2015 | Hered | E21B 19/07 166/382 |
| 2015/0337648 | A1 | 11/2015 | Zippel et al. | |
| 2016/0024862 | A1 | 1/2016 | Wilson et al. | |
| 2016/0138348 | A1 | 5/2016 | Kunec | |
| 2016/0145954 | A1 | 5/2016 | Helms et al. | |
| 2016/0177639 | A1 | 6/2016 | McIntosh et al. | |
| 2016/0201664 | A1 | 7/2016 | Robison et al. | |
| 2016/0215592 | A1 | 7/2016 | Helms et al. | |
| 2016/0230481 | A1 | 8/2016 | Misson et al. | |
| 2016/0245276 | A1 | 8/2016 | Robison et al. | |
| 2016/0342916 | A1 | 11/2016 | Arceneaux et al. | |
| 2016/0376863 | A1 | 12/2016 | Older et al. | |
| 2017/0037683 | A1 | 2/2017 | Heidecke et al. | |
| 2017/0044854 | A1 | 2/2017 | Hebebrand et al. | |
| 2017/0044875 | A1 | 2/2017 | Hebebrand et al. | |
| 2017/0051568 | A1 | 2/2017 | Wern et al. | |
| 2017/0067303 | A1 | 3/2017 | Thiemann et al. | |
| 2017/0067320 | A1 | 3/2017 | Zouhair et al. | |
| 2017/0074075 | A1* | 3/2017 | Liess | E21B 41/00 |
| 2017/0204846 | A1 | 7/2017 | Robison et al. | |
| 2017/0211327 | A1 | 7/2017 | Wern et al. | |
| 2017/0211343 | A1 | 7/2017 | Thiemann | |
| 2017/0234083 | A1* | 8/2017 | Tavakoli | E21B 19/07 166/77.52 |
| 2017/0284164 | A1 | 10/2017 | Holmes et al. | |

FOREIGN PATENT DOCUMENTS

| | | | |
|---|---|---|---|
| AU | 2014215938 | A1 | 9/2014 |
| AU | 2015234310 | A1 | 10/2015 |
| CA | 2 707 050 | A1 | 6/2009 |
| CA | 2 841 654 | A1 | 8/2015 |
| CA | 2944327 | A1 | 10/2015 |
| DE | 102007016822 | A1 | 10/2008 |
| EP | 0 250 072 | A2 | 12/1987 |
| EP | 1 619 349 | A2 | 1/2006 |
| EP | 1 772 715 | A2 | 4/2007 |
| EP | 1 961 912 | A1 | 8/2008 |
| EP | 1 961 913 | A1 | 8/2008 |
| EP | 2085566 | A2 | 8/2009 |
| EP | 2 322 357 | A1 | 5/2011 |
| EP | 2808483 | A2 | 12/2014 |
| EP | 3032025 | A1 | 6/2016 |
| GB | 1487948 | A | 10/1977 |
| GB | 2 077 812 | A | 12/1981 |
| GB | 2 180 027 | A | 3/1987 |
| GB | 2 228 025 | A | 8/1990 |
| GB | 2 314 391 | A | 12/1997 |
| WO | 2004/079153 | A2 | 9/2004 |
| WO | 2004/101417 | A2 | 11/2004 |
| WO | 2007/001887 | A2 | 1/2007 |
| WO | 2007/070805 | A2 | 6/2007 |
| WO | 2007127737 | A2 | 11/2007 |
| WO | 2008005767 | A1 | 1/2008 |
| WO | 2009/076648 | A2 | 6/2009 |
| WO | 2010057221 | A2 | 5/2010 |
| WO | 2012021555 | A2 | 2/2012 |
| WO | 2012100019 | A1 | 7/2012 |
| WO | 2012/115717 | A2 | 8/2012 |
| WO | 2014056092 | A1 | 4/2014 |
| WO | 2015/000023 | A1 | 1/2015 |
| WO | 2015/119509 | A1 | 8/2015 |
| WO | 2015/127433 | A1 | 8/2015 |
| WO | 2015176121 | A1 | 11/2015 |
| WO | 2016197255 | A1 | 12/2016 |
| WO | 2017/044384 | A1 | 3/2017 |
| WO | 2017040508 | A1 | 3/2017 |

OTHER PUBLICATIONS

EPO Extended European Search Report dated Jul. 19, 2018, for European Application No. 18159595.0.

EPO Extended European Search Report dated Jul. 17, 2018, for European Application No. 18158050.7.

Cookson, Colter, "Inventions Speed Drilling, Cut Costs," The American Oil & Gas Reporter, Sep. 2015, 2 pages.

Ennaifer, Amine et al. , "Step Change in Well Testing Operations," Oilfield Review, Autumn 2014: 26, No. 3, pp. 32-41.

Balltec Lifting Solutions, LiftLOK™ Brochure, "Highest integrity lifting tools for the harshest environments," 2 pages.

Balltec Lifting Solutions, CoilLOK™ Brochure, "Highest integrity hand-held coiled tubing handling tools," 2 pages.

Peters; Tool Coupler for Use With a Top Drive; U.S. Appl. No. 15/656,508, filed Jul. 21, 2017. (Application not attached to IDS.).

Fuehring et al.; Tool Coupler With Rotating Coupling Method for Top Drive; U.S. Appl. No. 15/445,758, filed Feb. 28, 2017. (Application not attached to IDS.).

Bell; Interchangeable Swivel Combined Multicoupler; U.S. Appl. No. 15/607,159, filed May 26, 2017. (Application not attached to IDS.).

Amezaga; Dual Torque Transfer for Top Drive System; U.S. Appl. No. 15/447,881, filed Mar. 2, 2017. (Application not attached to IDS.).

Zouhair; Coupler With Threaded Connection for Pipe Handler; U.S. Appl. No. 15/444,016, filed Feb. 27, 2017. (Application not attached to IDS.).

Liess; Downhole Tool Coupling System; U.S. Appl. No. 15/670,897, filed Aug. 7, 2017. (Application not attached to IDS.).

Muller et al; Combined Multi-Coupler With Rotating Locking Method for Top Drive; U.S. Appl. No. 15/721,216, filed Sep. 29, 2017. (Application not attached to IDS.).

Amezaga et al; Tool Coupler With Threaded Connection for Top Drive; U.S. Appl. No. 15/457,572, filed Mar. 13, 2017. (Application not attached to IDS.).

Wiens; Combined Multi-Coupler With Locking Clamp Connection for Top Drive; U.S. Appl. No. 15/627,428, filed Jun. 19, 2017. (Application not attached to IDS.).

Henke et al.; Tool Coupler With Sliding Coupling Members for Top Drive; U.S. Appl. No. 15/448,297, filed Mar. 2, 2017. (Application not attached to IDS.).

Schoknecht et al.; Combined Multi-Coupler With Rotating Fixations for Top Drive; U.S. Appl. No. 15/447,926, filed Mar. 2, 2017. (Application not attached to IDS.).

Metzlaff et al.; Combined Multi-Coupler for Top Drive; U.S. Appl. No. 15/627,237, filed Jun. 19, 2017. (Application not attached to IDS.).

Liess; Combined Multi-Coupler for Top Drive; U.S. Appl. No. 15/656,914, filed Jul. 21, 2017. (Application not attached to IDS.).

Liess et al.; Combined Multi-Coupler; U.S. Appl. No. 15/656,684, filed Jul. 21, 2017. (Application not attached to IDS.).

Amezaga et al.; Tool Coupler With Data and Signal Transfer Methods for Top Drive; U.S. Appl. No. 15/730,305, filed Oct. 11, 2017. (Application not attached to IDS.).

(56) References Cited

OTHER PUBLICATIONS

Liess; Tool Coupler With Threaded Connection for Top Drive; U.S. Appl. No. 15/806,560, filed Nov. 8, 2017. (Application not attached to IDS.).
EPO Partial European Search Report dated Jul. 31, 2018, for European Application No. 18159597.6.
European Patent Office; Extended Search Report for Application No. 18160808.4; dated Sep. 20, 2018; 8 total pages.
EPO Partial European Search Report dated Oct. 4, 2018, for European Patent Application No. 18159598.4.
EPO Extended European Search Report dated Oct. 5, 2018, for European Patent Application No. 18173275.1.
EPO Extended European Search Report dated Nov. 6, 2018, for European Application No. 18159597.6.
International Search Report and Written Opinion in PCT/US2018/042812 dated Oct. 17, 2018.
Extended Search Report in application EP18177312.8 dated Nov. 6, 2018.
EPO Extended European Search Report dated Nov. 15, 2018, for European Application No. 18177311.0.
A123 System; 14Ah Prismatic Pouch Cell; Nanophosphate® Lithium-Ion; www.a123systems.com; date unknown; 1 page.
Streicher Load/Torque Cell Systems; date unknown; 1 page.
3PS, Inc.; Enhanced Torque and Tension Sub with Integrated Turns; date unknown; 2 total pages.
Lefevre, et al.; Drilling Technology; Deeper, more deviated wells push development of smart drill stem rotary shouldered connections; dated 2008; 2 total pages.
PCT Invitaiton to Pay Additional Fees for International Application No. PCT/US2008/086699; dated Sep. 9, 2009; 7 total pages.
PCT Notification of Transmittal of the International Search Report and the Written Opinion of the International Searching Authority for International Application No. PCT/US2008/086699; dated Sep. 11, 2009; 19 total pages.
National Oilwell Varco; Rotary Shoulder Handbook; dated 2010; 116 total pages.
Weathertord; TorkSub™ Stand-Alone Torque Measuring System; dated 2011-2014; 4 total pages.
Australian Examination Report for Application No. 2008334992; dated Apr. 5, 2011; 2 total pages.
European Search Report for Application No. 08 860 261.0-2315; dated Apr. 12, 2011; 4 total pages.
Eaton; Spool Valve Hydraulic Motors; dated Sep. 2011; 16 total pages.
European Extended Search Report for Application No. 12153779.9-2315; dated Apr. 5, 2012; 4 total pages.
Australian Examination Report for Application No. 2012201644; dated May 15, 2013; 3 total pages.
Warrior; 250E Electric Top Drive (250-TON); 250H Hydraulic Top Drive (250-TON); dated Apr. 2014; 4 total pages.
Hydraulic Pumps & Motors; Fundamentals of Hydraulic Motors; dated Jun. 26, 2014; 6 total pages.
Warrior; Move Pipe Better; 500E Electric Top Drive (500 ton-1000 hp); dated May 2015; 4 total pages.
Canadian Office Action for Application No. 2,837,581; dated Aug. 24, 2015; 3 total pages.
European Extended Search Report for Application No. 15166062.8-1610; dated Nov. 23, 2015; 6 total pages.
Australian Examination Report for Application No. 2014215938; dated Feb. 4, 2016; 3 total pages.
Rexroth; Bosch Group; Motors and Gearboxes; Asynchronous high-speed motors 1 MB for high speeds; dated Apr. 13, 2016; 6 total pages.
Canadian Office Action for Application No. 2,837,581; dated Apr. 25, 2016; 3 total pages.
PCT Notification of Transmittal of the International Search Report and the Written Opinion of the International Searching Authority for International Application No. PCT/US2015/061960; dated Jul. 25, 2016; 16 total pages.
PCT Notification of Transmittal of the International Search Report and the Written Opinion of the International Searching Authority for International Application No. PCT/US2016/049462; dated Nov. 22, 2016; 14 total pages.
PCT Notification of Transmittal of the International Search Report and the Written Opinion of the International Searching Authority for International Application No. PCT/US2016/050542; dated Nov. 25, 2016; 13 total pages.
PCT Notification of Transmittal of the International Search Report and the Written Opinion of the International Searching Authority for International Application No. PCT/US2016/046458; dated Dec. 14, 2016; 16 total pages.
PCT Notification of Transmittal of the International Search Report and the Written Opinion of the International Searching Authority for International Application No. PCT/US2016/047813; dated Jan. 12, 2017; 15 total pages.
PCT Notification of Transmittal of the International Search Report and the Written Opinion of the International Searching Authority for International Application No. PCT/US2016/050139; dated Feb. 20, 2017; 20 total pages.
PCT Notification of Transmittal of the International Search Report and the Written Opinion of the International Searching Authority for International Application No. PCT/US2017/014646; dated Apr. 4, 2017; 14 total pages.
PCT Notification of Transmittal of the International Search Report and the Written Opinion of the International Searching Authority for International Application No. PCT/US2017/014224; dated Jun. 8, 2017; 15 total pages.
European Extended Search Report for Application No. 17152458.0-1609; dated Jun. 8, 2017; 7 total pages.
Australian Examination Report for Application No. 2017200371; dated Sep. 19, 2017; 5 total pages.
European Extended Search Report for Application No. 17195552.9-1614; dated Dec. 4, 2017; 6 total pages.
Australian Examination Report for Application No. 2017200371; dated Feb. 8, 2018; 6 total pages.
Canadian Office Action for Application No. 2,955,754; dated Mar. 28, 2018; 3 total pages.
Australian Examination Report for Application No. 2017200371; dated May 2, 2018; 4 total pages.
Canadian Office Action for Application No. 2,974,298; dated May 16, 2018; 3 total pages.
EPO Extended European Search Report dated Jun. 6, 2018, for European Application No. 18157915.2.
EPO Result of Consultation dated Mar. 29, 2019, for European Application No. 18177311.0.
PCT International Search Report and Written Opinion dated Oct. 23, 2018, for International Application No. PCT/US2018/044162.
EPO Partial Search Report dated Dec. 4, 2018, for European Patent Application No. 16754089.7.
PCT International Search Report and Written Opinion dated Dec. 19, 2018, for International Application No. PCT/US2018/042813.
PCT International Search Report and Written Opinion dated Jan. 3, 2019, for International Application No. PCT/US2018/0429021.
European Patent Office; Partial Search Report for Application No. 16 754 089.7 dated Dec. 4, 2018; 7 total pages.
EPO Extended European Search Report dated Feb. 18, 2019, for European Application No. 18159598.4.
Office Action in related application EP 18177311.0 dated Mar. 3, 2019.

* cited by examiner

COMBINED MULTI-COUPLER WITH LOCKING CLAMP CONNECTION FOR TOP DRIVE

BACKGROUND OF THE INVENTION

Field of the Invention

The present disclosure generally relates to methods and apparatus for coupling a top drive to a tool for use in a wellbore.

Description of the Related Art

A wellbore is formed to access hydrocarbon bearing formations, e.g. crude oil and/or natural gas, by the use of drilling. Drilling is accomplished by utilizing a drill bit that is mounted on the end of a tubular string, such as a drill string. To drill within the wellbore to a predetermined depth, the drill string, is often rotated by a top drive or rotary table on a surface platform or rig, and/or by a downhole motor mounted towards the lower end of the drill string. After drilling to a predetermined depth, the drill string and drill bit are removed, and a section of casing is lowered into the wellbore. An annulus is thus formed between the string of casing and the formation. The casing string is temporarily hung from the surface of the well. The casing string is cemented into the wellbore by circulating cement into the annulus defined between the outer wall of the casing and the borehole. The combination of cement and casing strengthens the wellbore and facilitates the isolation, of certain areas of the formation behind the casing for the production of hydrocarbons.

In the construction and completion of oil and gas wells, a drilling rig is used to facilitate the insertion and removal of tubular strings into a wellbore. Tubular strings are constructed by inserting a first tubular into a wellbore until only the upper end of the tubular extends out of the wellbore. A gripping member close to the surface of the wellbore then grips the upper end of the first tubular. The upper end of the first tubular has a threaded box end for connecting to a threaded pin end of a second tubular or tool. The second tubular or tool is lifted over the wellbore center, lowered onto or "stabbed into" the upper end of the first tubular, and then rotated such that the pin end of the second tubular or tool is threadedly connected to the box end of the first tubular.

Top drives are equipped with a motor for rotating the drill string. The quill of the top drive is typically threaded for connection to an upper end of the drill pipe in order to transmit torque to the drill string. Conventional top drives also threadedly connect to tools for use in the wellbore, An operator on the rig may be required to connect supply lines, such as hydraulic, pneumatic, data, and/or power lines, between conventional top drives and the tool complete the connection.

The threaded connection between conventional top drives and tools allows only for rotation in a single direction. Manual connection of supply lines can be time-consuming and dangerous to rig personnel. Therefore, there is a need for improved apparatus and methods for connecting top drives to tools.

SUMMARY OF THE INVENTION

In one embodiment, a method for coupling a top drive to a tool includes moving the tool adjacent to the top drive, the top drive including a drive stem having a key movable to an extended position and the tool including an adapter having a key recess configured to receive the key in the extended position, inserting the drive stern into the adapter, and biasing the key towards the extended position to couple the drive stem and the adapter.

In another embodiment, a coupling system for a top drive and a tool includes a drive stem of the top drive configured to transfer torque to the tool, a key disposed on the drive stem and movable to an extended position, an adapter of the tool configured to receive the drive stem, a key recess disposed on the adapter and configured to receive the key in the extended position, and a biasing member configured to bias the key towards the extended position.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

Figure 1:
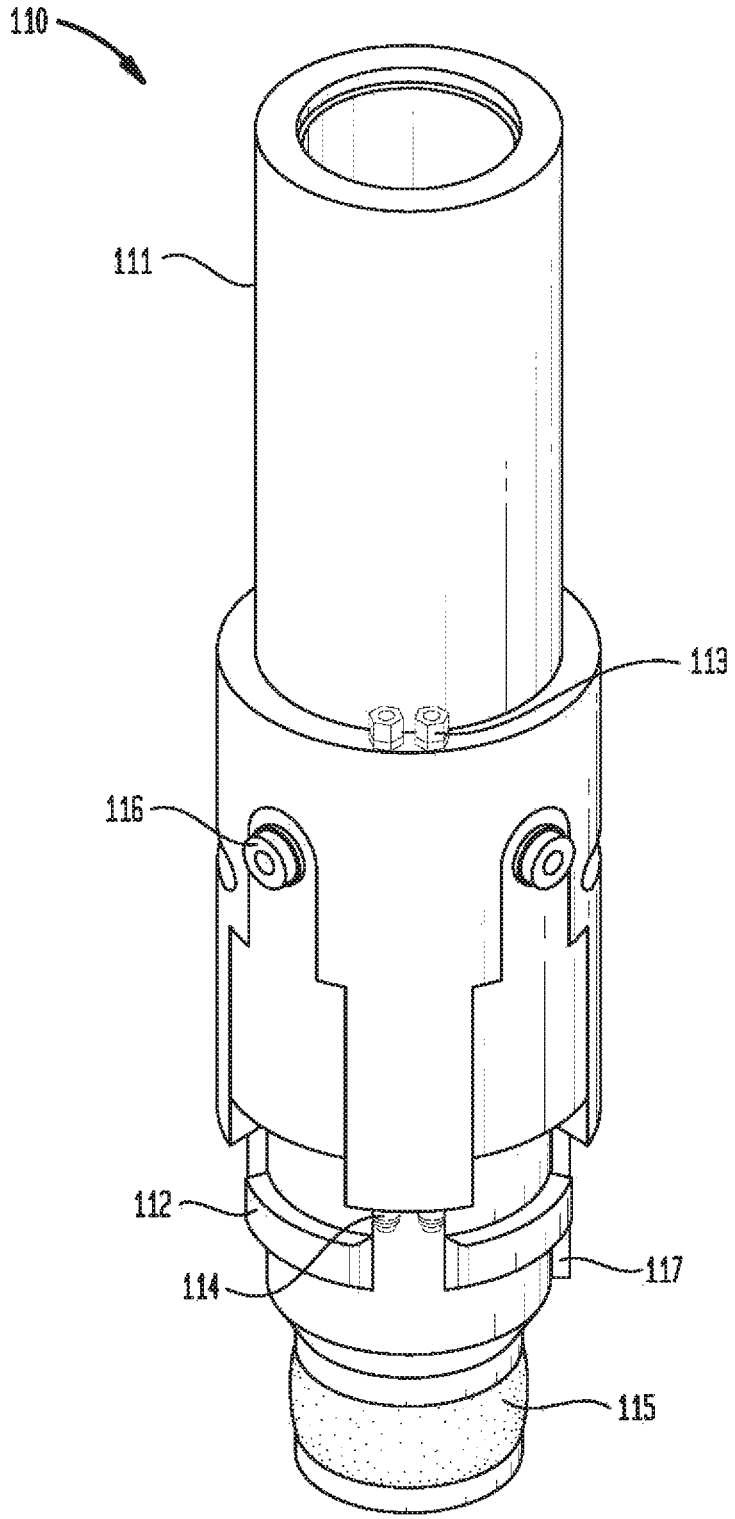
FIG. 1 illustrates a drive member of a top drive.

FIG. 1 illustrates a drive member 110 of a top drive. The drive member 110 may include a drive stem 111, one or more latch members, such as one or more keys 112, one or more utility couplers 113, 114, and one or more hydraulic lines. The drive stem 111 may be tubular having a bore therethrough. The bore of the drive stem 111 may be configured to transfer fluid, such as drilling fluid, from the top drive to the tool. The drive stem 111 may be disposed in a housing of the top drive. The drive stem 111 may be configured to rotate relative to the housing. The drive stem 111 may be rotated by a motor of the top drive. The drive stem 111 may include a groove formed about a circumference. The groove may be an annular groove. The groove may be configured to receive a seal 115. The seal 115 may be an elastomer. The seal 115 may be an annular seal. The seal 115 may be configured to engage and seal against a bore of an adapter 120 of a tool. The seal 115 may be configured to prevent fluid such as drilling fluid, from leaking between the adapter 120 and the drive stem 111.

The one or more keys 112 may be disposed about the circumference of the drive stem 111. The one or more keys 112 may be spaced circumferentially apart on the drive stem 111. Each of the one or more keys 112 may include a hole. The hole may be formed radially through the key. The hole may have a threaded inner surface. The hole may be configured to receive an actuator, such as a threaded body cylinder 116. The threaded body cylinder 116 may be operable to engage the drive stem 111. The cylinder 116 may have an outer threaded body. The outer threaded body may be configured to mate with the threaded inner surface of the hole. The cylinder 116 may include a piston rod. The piston rod may be movable between, an extended position and a retracted position. In the extended position, the piston rod may engage an outer surface of the drive stem 111. The piston rod may push against the outer surface of the drive stem 111. The threaded body cylinder 116 may be configured to move a corresponding key between an extended position and a retracted position.

The one or more utility couplers 113, 114 may be disposed on opposite longitudinal ends of a flange of the drive stem 111. The one or more utility couplers 113 may be disposed at an upper longitudinal end of the flange of the drive stem 111. The one or more utility couplers 113 may connect to one or more supply lines. The one or more supply lines may connect to a utility transfer assembly of the drive stem 111. The utility transfer assembly may be disposed on the drive stem. The utility transfer assembly may be disposed about a circumference of the drive stem. The utility transfer assembly may be configured to transfer power, data, electronics, hydraulics, and/or pneumatics between stationary and rotational parts of the top drive, such as between the housing and the drive stem 111. The utility transfer assembly may include a slip ring assembly and/or a hydraulic swivel. The slip ring assembly may include a ring member having one or more contact rings (such as copper rings) that rotate with the drive stem 111. The slip ring assembly may include a support housing for supporting one or more contact members (such as brushes) that are non-rotatively coupled to the housing of the top drive. The non-rotating contact members contact the contact rings of the rotating ring member, thereby providing an electrical connection across a rotating interface. In this manner, electronic signals may be sent between the stationary and rotational parts of the top drive. Additionally, the hydraulic swivel may provide transfer of hydraulic fluids for pneumatic and/or hydraulic operation of the tool. The one or more utility supply lines may transfer at least one of power, data, electronics, hydraulics, and/or pneumatics between the utility transfer assembly and the one or more utility couplers 113.

In addition, the one or more utility supply lines may connect to the threaded body cylinder 116. The one or more utility supply lines may transfer at least one of electronics, hydraulics, and/or pneumatics between the utility transfer assembly and the threaded body cylinder 116 in order to operate the threaded body cylinder 116. One or more channels may be formed longitudinally through the flange of the drive stem 111. The one or more channels may be configured to transfer power, data, electronics, hydraulics, and/or pneumatics between the one or more utility couplers 113 and the one or more utility couplers 114. The one or more utility couplers 114 may be disposed at a lower longitudinal end of the flange, opposite the one or more utility couplers 113.

The drive stem 111 may include an alignment key 117. The alignment key 117 may extend longitudinally downward from the flange of the drive stem 111. The alignment key 117 may extend past a lower end of the one or more keys 112. The alignment key 117 may have a tapered end. The alignment key 117 may be configured to facilitate alignment of the drive member 111 and the adapter 120.

Figure 2:
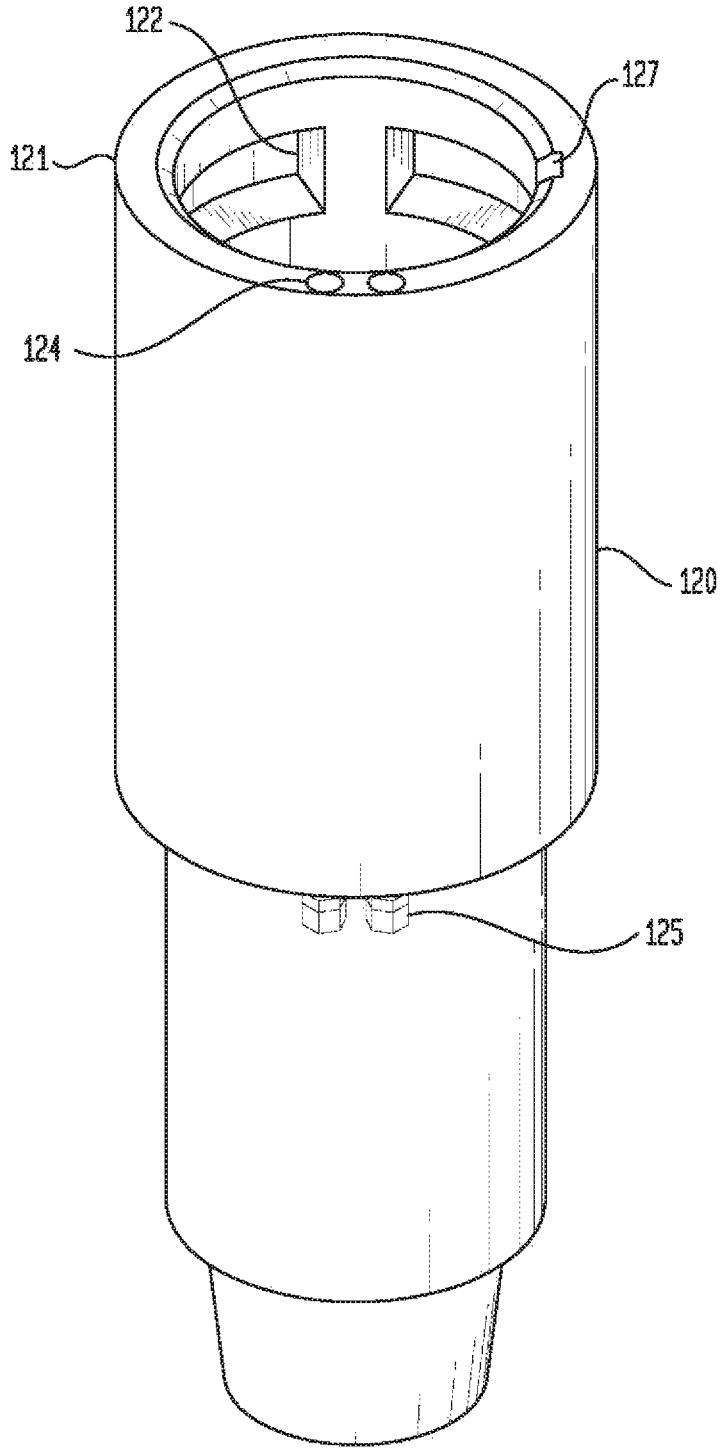
FIG. 2 illustrates an adapter of a tool.

FIG. 2 illustrates the adapter 120 of a tool. The adapter 120 may be tubular having a bore therethrough. The adapter 120 may be integrally formed with the tool. The adapter 120 may connect to the tool at a lower longitudinal end. The bore of the adapter 120 may be configured to receive the drive stem 111. The adapter 120 may include a lip 121, one or more latch recesses, such as one or more key recesses 122, one or more utility couplers 124, 125, and an alignment key slot 127. The lip 121 may be disposed at an upper longitudinal end of the adapter 120. The lip 121 may include a tapered shoulder. The tapered shoulder may be configured to engage the one or more keys 112 of the drive stem 111. Engagement of the tapered shoulder with the one or more keys 112 may pivotally move the one or more keys 112 to the retracted position. The one or more utility couplers 124 may be disposed at an upper longitudinal end of the adapter 120. The one or more utility couplers 124 may be disposed longitudinally through the lip 121 of the adapter 120. The one or more utility couplers 124 may be configured to receive the one or more utility couplers 114. The one or more utility couplers 124 may be configured to receive and transfer power, data, electronic, hydraulics, and/or pneumatics between the drive stem 111 and the adapter 120. One or more channels may be formed longitudinally through the adapter 120. The one or more channels may connect at an upper longitudinal end to the one or more utility couplers 124. The one or more channels may receive and, transfer power, data, electronic, hydraulics, and/or pneumatics between the one or more utility couplers 124 and the one or more utility couplers 125. The one or more utility couplers 125 may be configured to connect to one or more supply lines of the tool. The one or more supply lines may be configured to transfer power, data, electronics, hydraulics, and/or pneumatics to components of the tool.

Figure 3:
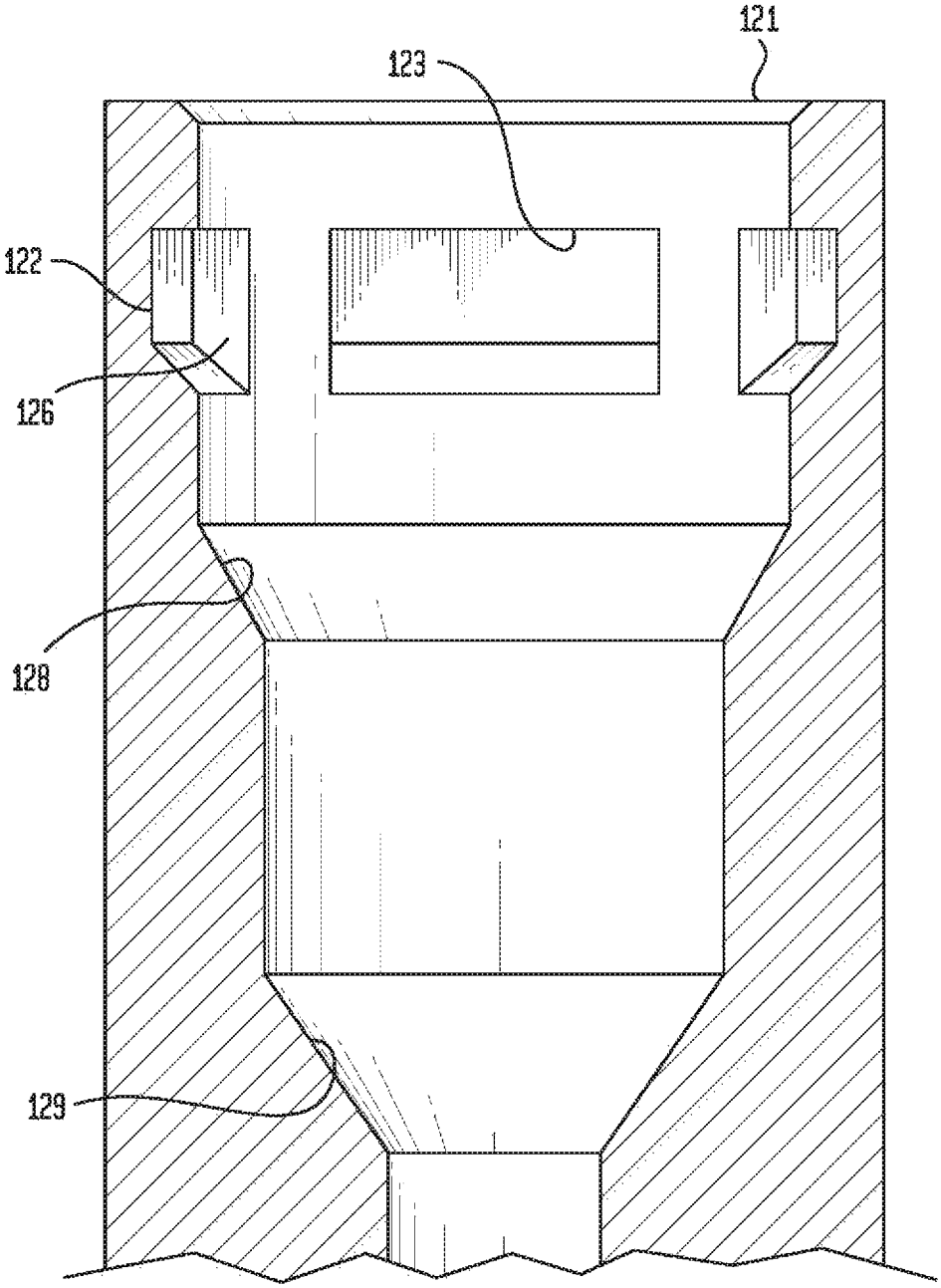
FIG. 3 illustrates a cross-section of the adapter.

FIG. 3 illustrates a cross-section of the adapter 120 of the tool. The one or more key recesses 122 may be formed in an inner surface of the adapter. The one or more key recesses 122 may be formed adjacent the bore of the adapter 120. The one or more key recesses 122 may be configured to receive a corresponding dog of the one or more keys 112. The one or more key recesses 122 may include a load profile 123 and a torque profile 126. The load profile 123 may be an upper shoulder of the key recess. The torque profile 126 may be side walls of the key recess. The bore of the adapter 120 may include a stepped profile. The stepped profile may include one or more tapered surfaces 128, 129. A lower edge of the tapered surface 128 may be configured to engage the seal 115.

Figure 4:
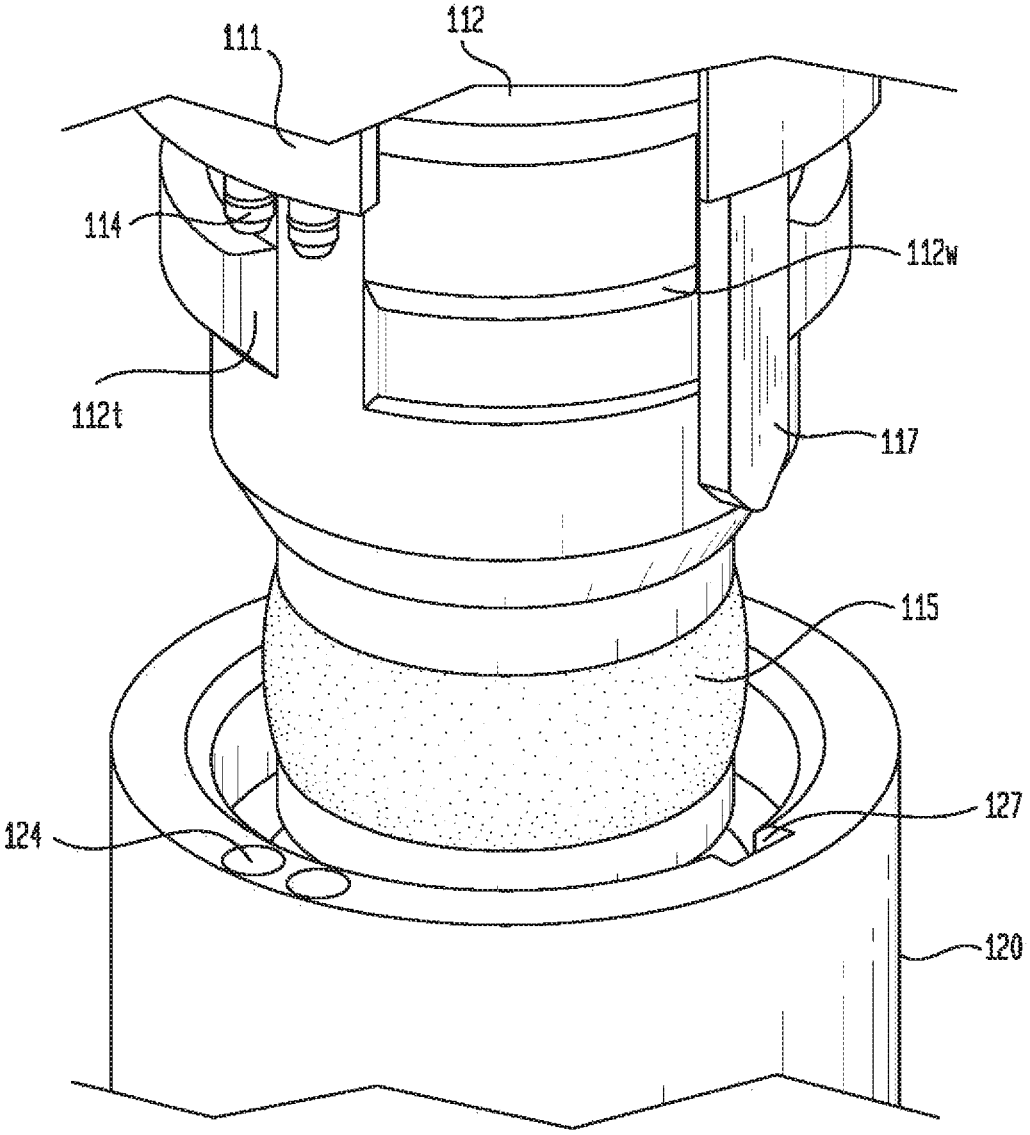
FIG. 4 illustrates the drive member and the adapter of a combined multi-coupler system, according to a first embodiment.

FIG. 4 illustrates the drive stem 111 and the adapter 120 of the combined multi-coupler system. Each of the one or more keys 112 may include a torque profile 112*t* and a load profile 112*w*. The torque profile 112*t* may be the side walls of the key. The torque profile 112*t* may be configured to engage the torque profile 126 of the adapter 120. Engagement of the torque profile 112*t* and the torque profile 126 may bidirectionally torsionally couple the drive stem 111 and the adapter 120. In the engaged position, the torque profile 112*t* may transfer torque to the torque profile 126, thereby rotating the adapter 120 and the tool with the drive stem 111. The alignment key slot 127 may be configured to receive the alignment key 117 of the drive stem 111. The alignment key 117 may enter the alignment key slot 127. The alignment key 117 and alignment key slot 127 may be configured to facilitate alignment of the one or more utility couplers 114 with the one or more utility couplers 124. In addition, the alignment key 117 and slot 127 may be configured to facilitate alignment of the one or more keys 112 and the one or more key recesses 122.

Figure 5:
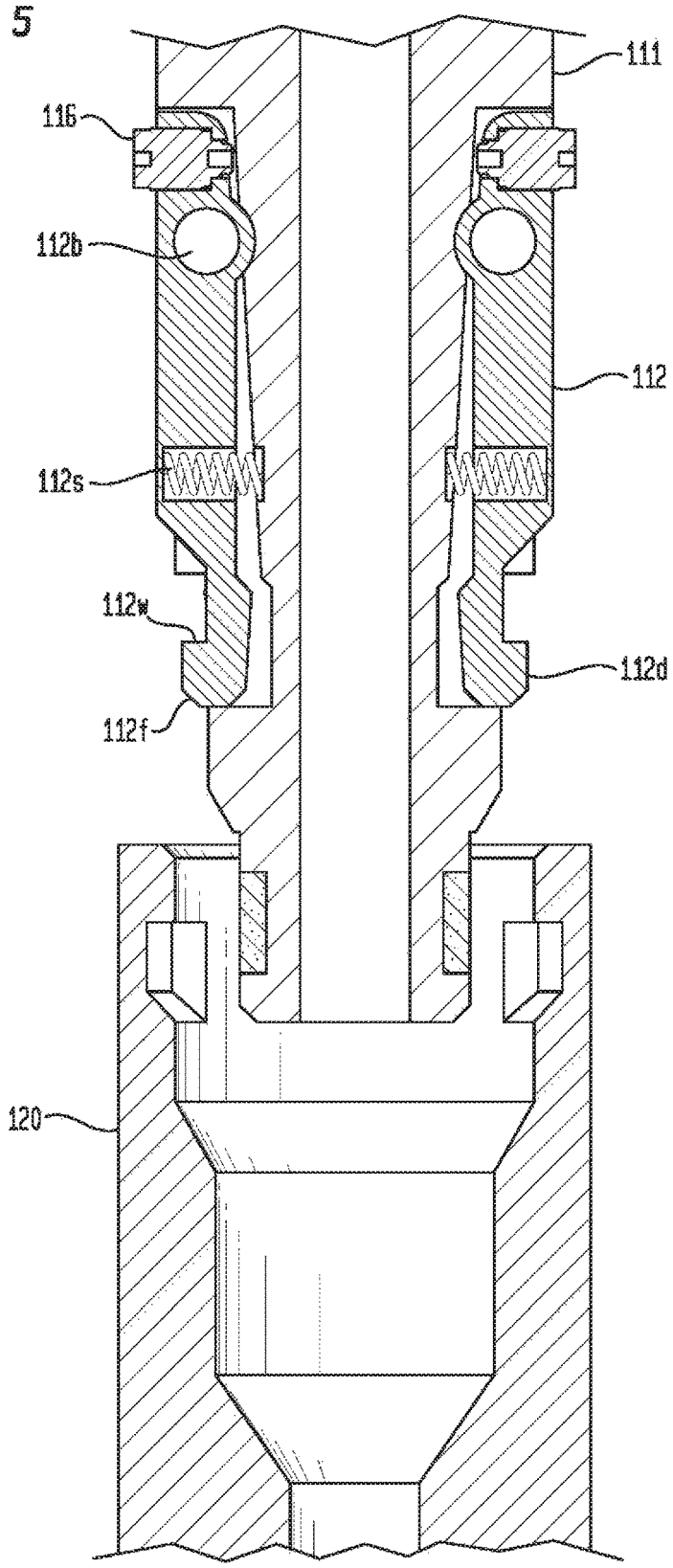
FIGS. 5-9 illustrate operation of the drive member and the adapter of the combined multi-coupler system.

FIG. 5 illustrates insertion of the drive stem 111 in the bore of the adapter 120. The drive stem 111 may be rotated to align the alignment key 117 and the alignment key slot 127. As the drive stem 111 moves into the bore of the adapter 120, the alignment key 117 may enter the alignment key slot 127. The alignment key 117 and slot 127 ensure that dogs 112*d* of the one or more keys 112 are aligned with the one or more key recesses 122. The one or more keys 112 may be coupled to the drive stem 111 by a fastener, such as a bolt 112*b*. The bolt 112*b* may pivotally couple a corresponding key to the drive stem 111. The one or more keys 112 may be pivotally movable between the retracted position and the extended position. The one or more keys 112 may include a recess. The recess may be formed in an inner surface of the corresponding key. The recess may be located longitudinally below the bolt 112*b* of the corresponding key. The recess may extend radially outward at least partially through the corresponding key. A biasing member, such as spring 112*s*, may be disposed in the recess. The spring 112*s* may be configured to bias the corresponding key towards the extended position, shown in FIG. 5. The threaded body cylinder 116 may be configured to overcome the biasing force of the spring 112*s* and move the corresponding key to the retracted position, shown in FIG. 9.

Each of the one or more keys 112 may include the dog 112*d* at a lower longitudinal end. The dog 112*d* may include the torque profile 112*t* and the load profile 112*w*. The dog 112*d* may include a tapered surface 112*f* at a lower longitudinal end. The torque profile 112*t* may be configured to torsionally couple the drive stem 111 and the adapter 120. The torque profile 112*t* may be configured to provide bidirectional torque transfer between the drive stem 111 and the adapter 120. The load profile 112*w* may be configured to support a weight of the adapter 120 and the tool. The load profile 112*w* may be configured to longitudinally couple the drive stem 111 and the adapter 120.

Figure 6:
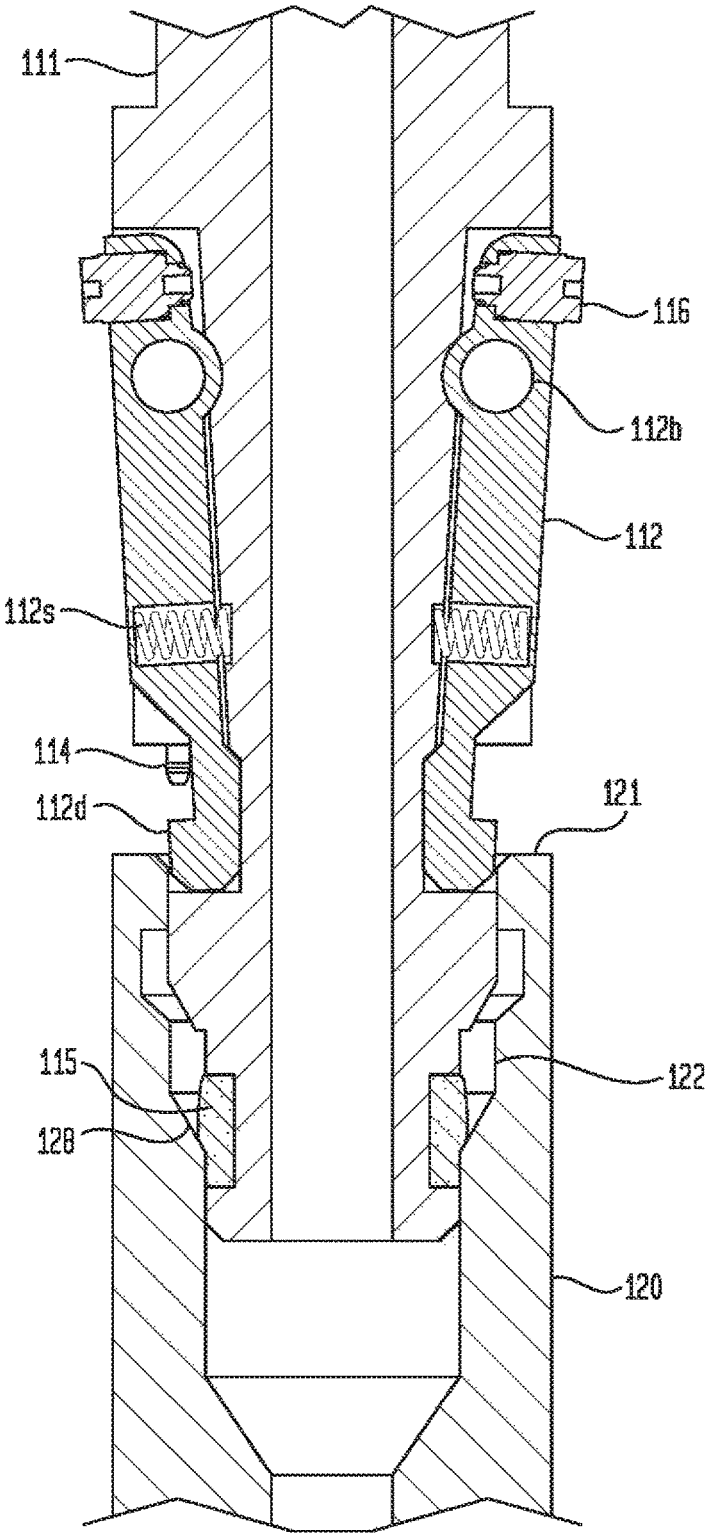

The CMC is operable to torsionally and longitudinally couple the drive stem 111 and the adapter 120. The tool and the adapter 120 are moved adjacent to the top drive and the drive stem 111. Next, the drive stem 111 is inserted into the adapter 120, as shown in FIGS. 5 and 6. The drive stem 111 enters the bore of the adapter 120. The tapered surface of the lip 121 of the adapter 120 engages the tapered surface 112*f* of the dog 112*d*. The tapered surface of the lip 121 forces the dogs 112*d* to the retracted position, during insertion of the drive stem 111. The force of the tapered surface of the lip 121 acting on the dog 112*d* overcomes the biasing force of the spring 112*s*. The seal 115 engages a lower longitudinal end of the tapered surface 128 and seals against the bore of the adapter 120.

Figure 7:
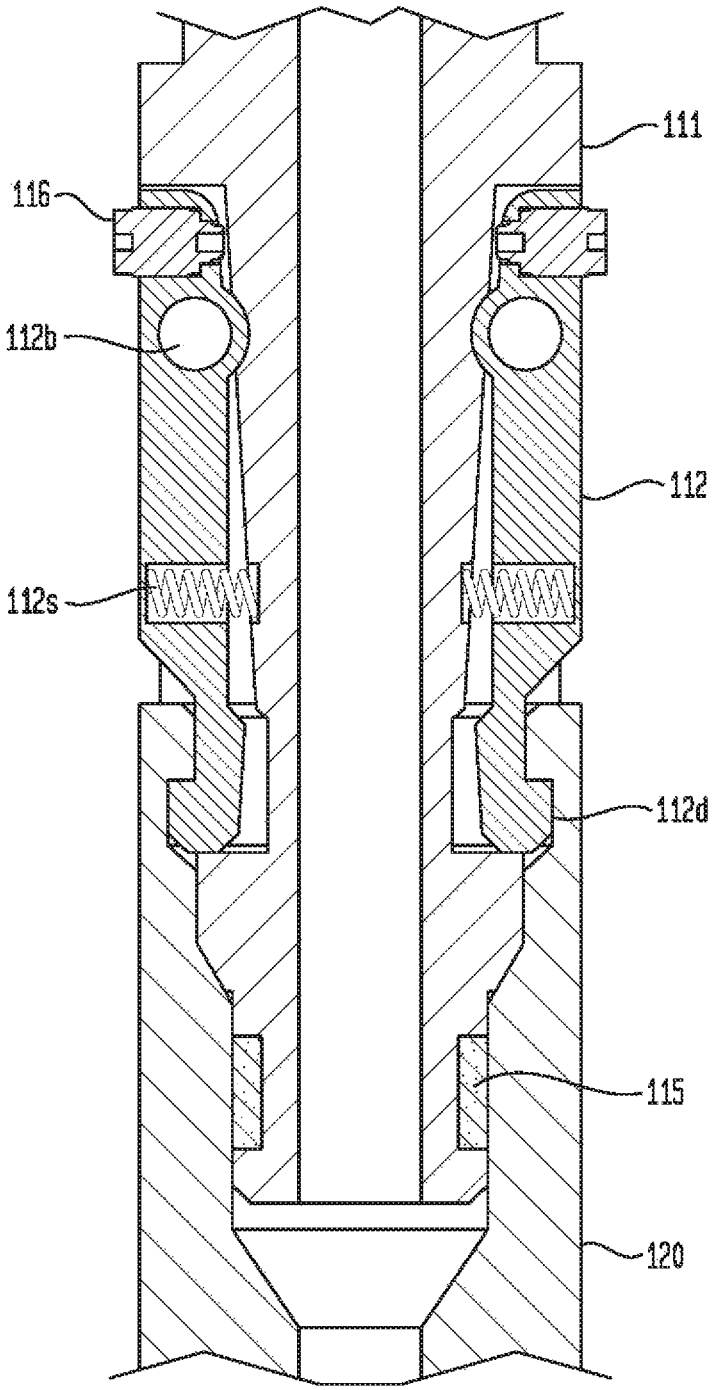

The drive stem 111 continues traveling into the bore of the adapter 120 until the dogs 112*d* are located adjacent the one or more key recesses 122, as shown in FIG. 7. The spring 112*s* biases the corresponding key towards the extended position, shown in FIG. 7. In the extended position, the dog 112*d* is disposed in the corresponding key recess. The torque profile 112*t* engages the torque profile 126 of the corresponding key recess to bidirectionally torsionally couple the adapter 120 and the drive stem 111. The load profile 112*w* engages the load profile 123 of the corresponding key recess to longitudinally couple the adapter 120 and the drive stem 111. The load profile 112*w* supports and transfers the weight of the adapter 120 and the tool to the drive stem 111. The one or more utility couplers 114 engage and connect to the one or more utility couplers 124. Engagement of the utility couplers 114, 124 provides transfer of power, data, electronic, hydraulics, and/or pneumatics between the drive stem 111 and the adapter 120. The seal 115 seals against the inner surface of the adapter 120.

Figure 8:
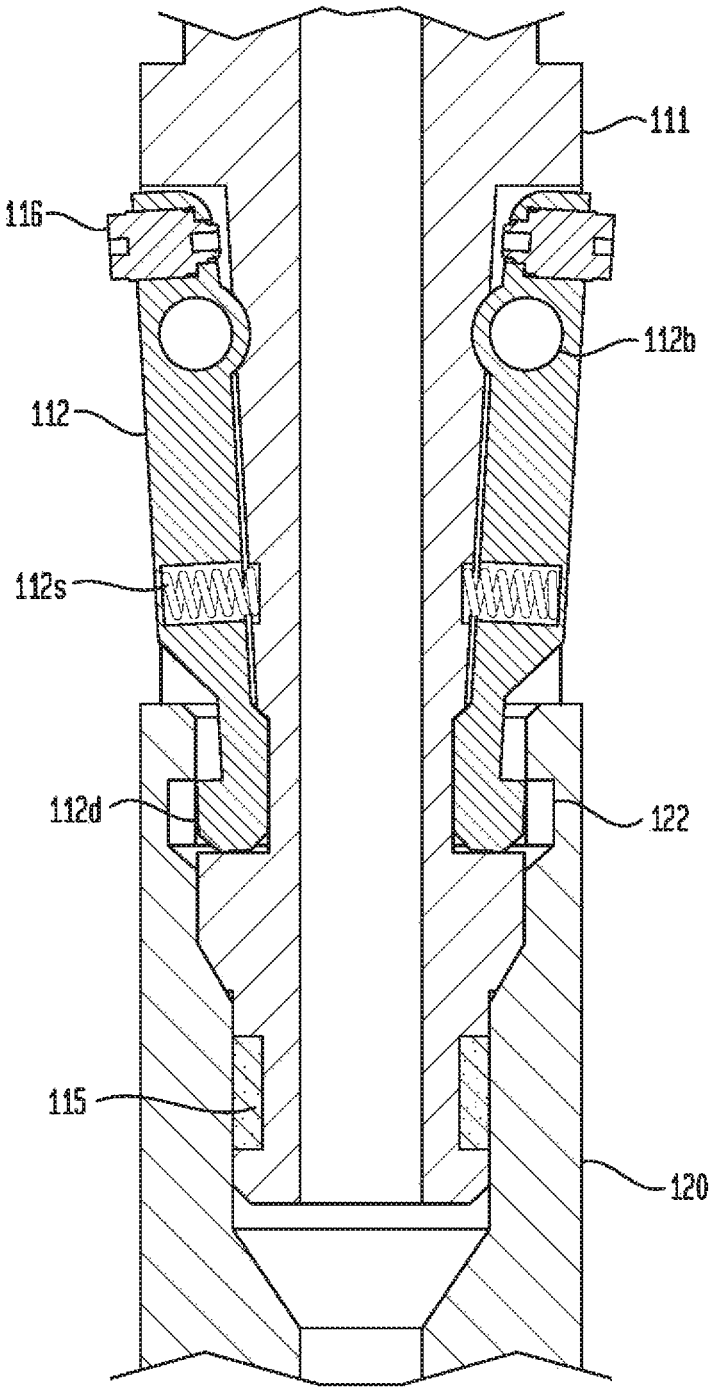
Figure 9:
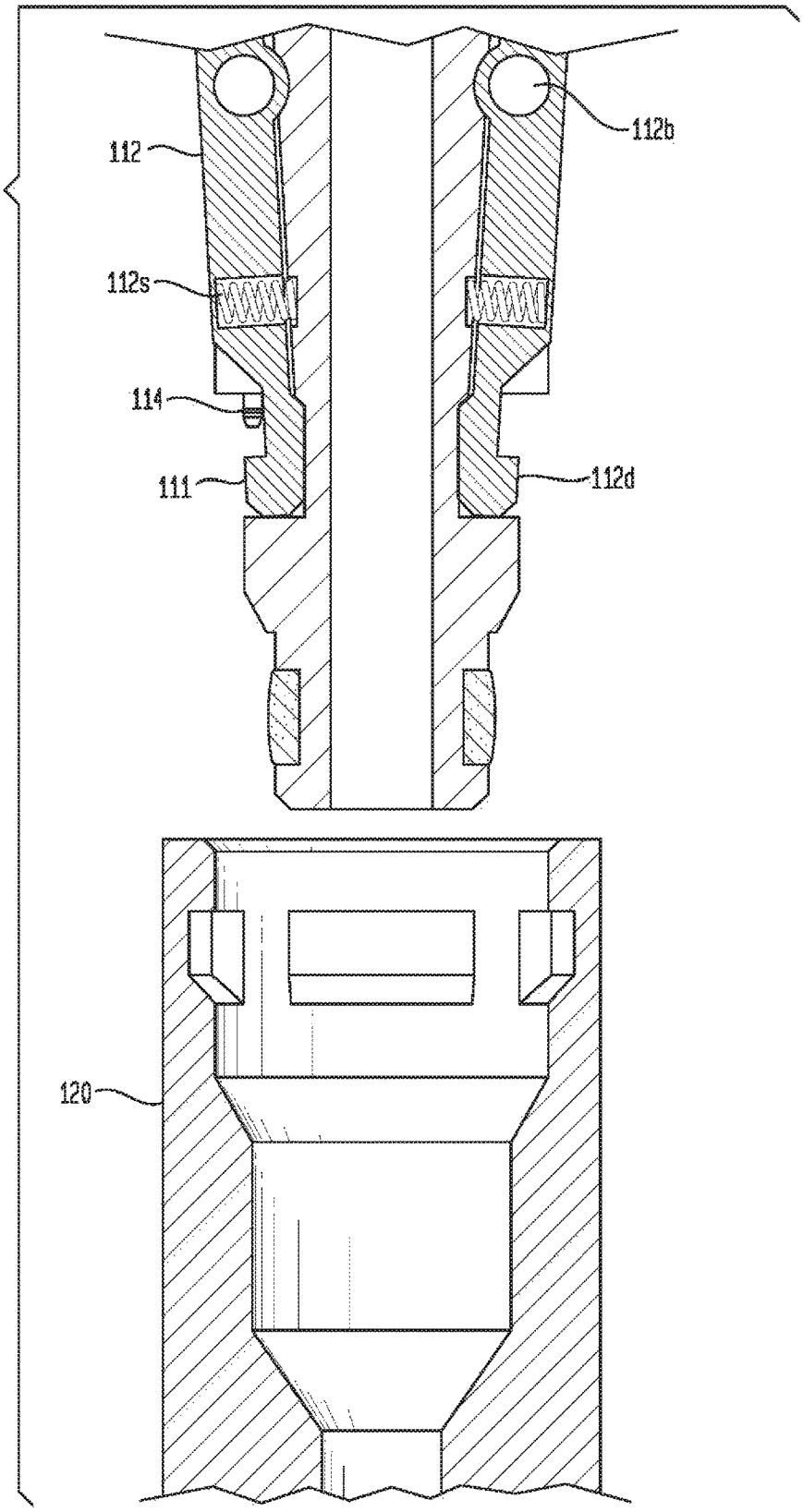

In order to decouple the adapter 120 and the drive stem 111, the threaded body cylinder 116 is actuated to move the dog 112*d* out of the corresponding key recess, as shown in FIG. 8. The threaded body cylinder 116 pushes against an outer surface of the drive stem 111. The one or more keys 112 pivot about the corresponding bolt 112*b*, moving the corresponding dog 112*d* out of the corresponding key recess. The threaded body cylinder 116 moves the one or more keys 112 to the retracted position, shown in FIG. 8. Once disengaged, the drive stem 111 is removed from the bore of the adapter 120. As the drive stem 111 moves out of the adapter 120, the utility couplers 114, 124 disengage and disconnect, The alignment key 117 moves out of the alignment key slot 127 and the drive stem 111 and adapter 120 are decoupled, as shown in FIG. 9.

Alternatively, the threaded body cylinder 116 may be actuated to move the corresponding key 112 to the retracted position during insertion of the drive stem 111 in the bore of the adapter 120. Once the drive stem 111 is fully inserted into the bore of the adapter 120 and the dogs 112*d* of the one or more keys 112 are aligned with the one or more key recesses 122, the threaded body cylinder 116 may be deactuated and the spring 112*s* may bias the dogs 112*d* into the extended position to engage with the one or more key recesses 122.

Figure 10:
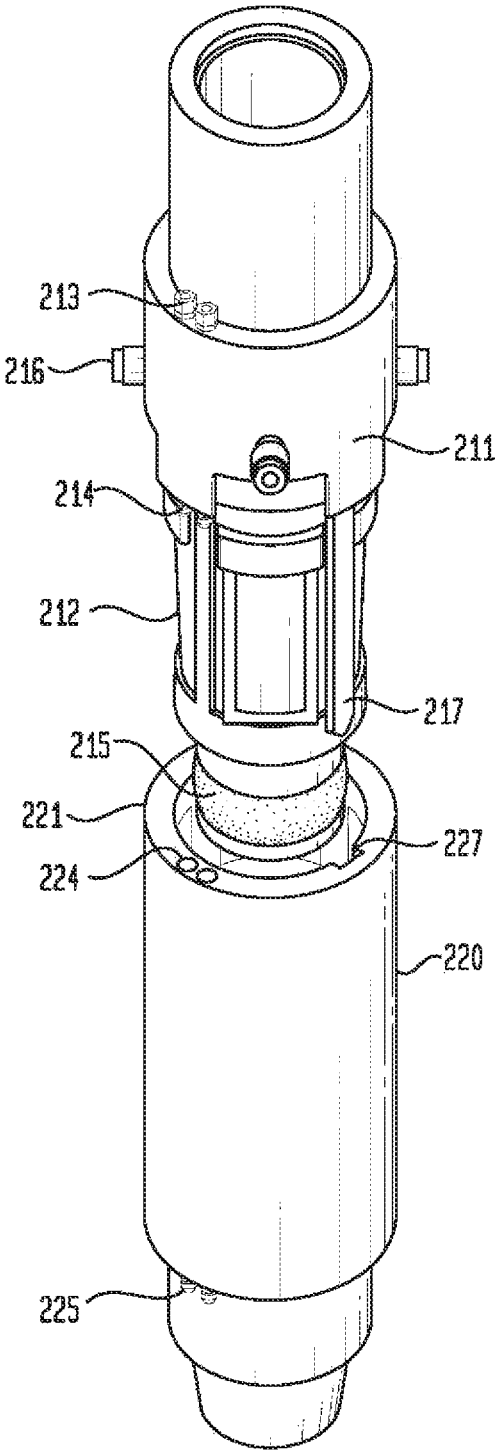
FIG. 10 illustrates a drive member of a top drive and an adapter of a tool for a combined multi-coupler system, according to a second embodiment.

FIG. 10 illustrates a CMC, according to a second embodiment. The CMC may include a drive member 210 of a top drive and an adapter 220 of a tool. The drive member 210 may include a drive stem 211, one or more latch members, such as one or more keys 212, one or more utility couplers 213, 214, a seal 215, an actuator, such as threaded body cylinder 216, and an alignment key 217. The drive stem 211 may be tubular having a bore therethrough. The bore of the drive stem 211 may be configured to transfer fluid, such as drilling fluid, from the top drive to the tool. The drive stem 211 may be disposed in a housing of the top drive. The drive stem 211 may be configured to rotate relative to the housing. The drive stem 211 may be rotated by a motor of the top drive. The drive stem 211 may include a groove formed about a circumference. The groove may be an annular groove. The groove may be configured to receive the seal 215. The seal 215 may be an elastomer. The seal 215 may be an annular seal. The seal 215 may be configured to engage and seal against a bore of the adapter 220 of a tool. The seal 215 may be configured to prevent fluid, such as drilling fluid, from leaking between the adapter 220 and the drive stem 211.

The one or more utility couplers 213, 214 may be disposed on opposite longitudinal ends of a flange of the drive stem 211. The one or more utility couplers 213 may be disposed at an upper longitudinal end of the flange of the drive stem 211. The one or more utility couplers 213 may connect to one or more supply lines. The one or more supply lines may connect to a utility transfer assembly of the drive stem 211. The utility transfer assembly may be disposed on the drive stem 211. The utility transfer assembly may be disposed about a circumference of the drive stem 211. The utility transfer assembly may be configured to transfer power, data, electronics, hydraulics, and/or pneumatics between stationary and rotational parts of the top drive, such as between the housing and the drive stem 211. The utility transfer assembly may include a slip ring assembly and/or a hydraulic swivel. The slip ring assembly may include a ring member having one or more contact rings (such as copper rings) that rotate with the drive stem. The slip ring assembly may include a support housing for supporting one or more contact members (such as brushes) that are non-rotatively coupled to the housing of the top drive. The non-rotating contact members contact the contact rings of the rotating ring member, thereby providing an electrical connection across a rotating interface. In this manner, electronic signals may be sent between the stationary and rotational parts of the top drive. Additionally, the hydraulic swivel may provide transfer of hydraulic fluids for pneumatic and/or hydraulic operation of the tool. The one or more utility supply lines may transfer at least one of power, data, electronics, hydraulics, and/or pneumatics between the utility transfer assembly and the one or more utility couplers 213.

In addition, the one or more utility supply lines may connect to the threaded body cylinder 216. The one or more utility supply lines may transfer at least one of electronics, hydraulics, and/or pneumatics between the utility transfer assembly and the threaded body cylinder 216 in order to operate the threaded body cylinder 216. One or more channels may be formed longitudinally through the flange of the drive stem 211. The one or more channels may be configured to transfer power, data, electronics, hydraulics, and/or pneumatics between the one or more utility couplers 213 and the one or more utility couplers 214. The one or more utility couplers 214 may be disposed at a lower longitudinal end of the flange, opposite the one or more utility couplers 213.

The one or more keys 212 may be at least partially disposed on an outer surface of the drive stem 211. The one or more keys 212 may be spaced circumferentially apart on the drive stem 211. The one or more keys 212 may be pivotally coupled to the drive stem 211. The one or more keys 212 may be pivotally movable between an extended position and a retracted position. The drive stem 211 may include a hole formed radially therethrough. The hole may be threaded. The hole may be configured to receive the threaded body cylinder 216. The threaded body cylinder 216 may be operable to engage a corresponding key. The threaded body cylinder 216 may be configured to move a corresponding key between the extended position and the retracted position. The drive stem 211 may include an alignment key 217. The alignment key 217 may extend longitudinally downward from the flange of the drive stem 211. The alignment key 217 may extend past a lower end of the one or more keys 212. The alignment key 217 may have a tapered end. The alignment key 217 may be configured to facilitate alignment of the drive member 211 and the adapter 220.

The adapter 220 may be tubular having a bore therethrough. The adapter 220 may be integrally formed with the tool. The adapter 220 may connect to the tool at a lower longitudinal end. The bore of the adapter 220 may be configured to receive the drive stem 211. The adapter 220 may include a lip 221, one or more utility couplers 224, 225, and an alignment key slot 227. The lip 221 may be disposed at an upper longitudinal end of the adapter 220. The lip 221 may include a tapered shoulder. The tapered shoulder may be configured to engage the one or more keys 212 of the drive stem 211. Engagement of the tapered shoulder with the one or more keys 212 may pivotally move the one or more keys 212 to the retracted position. The one or more utility couplers 224 may be disposed at an upper longitudinal end of the adapter 220. The one or more utility couplers 224 may be disposed longitudinally through the lip 221 of the adapter 220. The one or more utility couplers 224 may be configured to receive the one or more utility couplers 214. The one or more utility couplers 224 may be configured to receive and transfer power, data, electronic, hydraulics, and/or pneumatics between the drive stem 211 and the adapter 220. One or more channels may be formed longitudinally through the adapter 220. The one or more channels may connect at an upper longitudinal end to the one or more utility couplers 224. The one or more channels may receive and transfer power, data, electronic, hydraulics, and/or pneumatics between the one or more utility couplers 224 and the one or more utility couplers 225. The one or more utility couplers 225 may be configured to connect to one or more supply lines of the tool. The one or more supply lines may be configured to transfer power, data, electronics, hydraulics, and/or pneumatics to components of the tool. The alignment key slot 227 may be configured to receive the alignment key 217 of the drive stem 211. The alignment key 217 may enter the alignment key slot 227. The alignment key 217 and alignment key slot 227 may be configured to facilitate alignment of the one or more utility couplers 214 with the one or more utility couplers 224.

Figure 11:
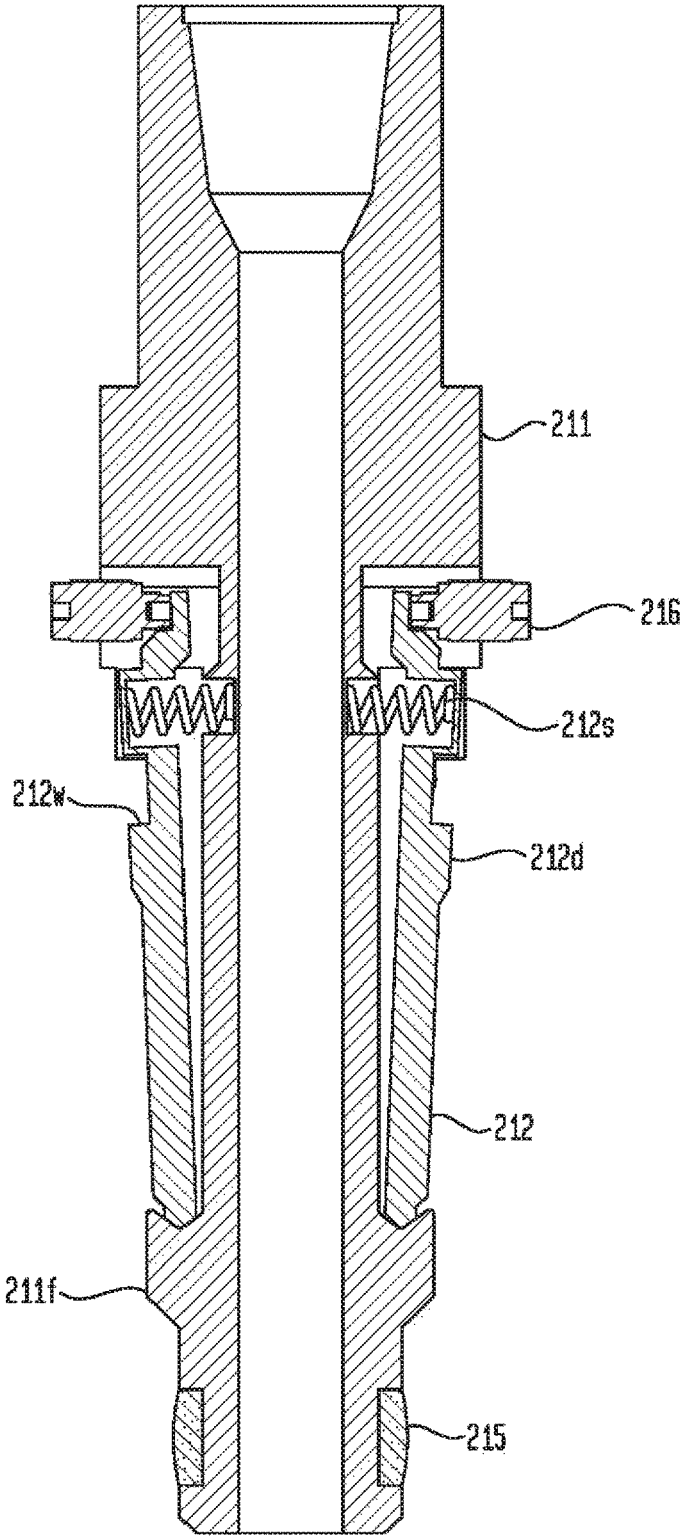
FIG. 11 illustrates a cross-sectional view of the adapter, according to the second embodiment.

FIG. 11 illustrates a cross-sectional view of the drive stem 211. Each of the one or more keys 212 may include a dog 212*d*. The dog 212*d* may include a torque profile and a load profile 212*w*. The torque profile may be the side walls of the key. The torque profile may be configured to engage a torque profile of the adapter 120. Engagement of the torque profiles may bidirectionally torsionally couple the drive stem 211 and the adapter 220. In the engaged position, the torque profile of the corresponding key may transfer torque to the torque profile of the adapter 220, thereby rotating the adapter 220 and the tool with the drive stem 211. A biasing member, such as spring 212*s*, may be at least partially disposed in a recess of the drive stem 211. The spring 212*s* may be configured to bias a corresponding key towards the extended position, shown in FIG. 11. Each of the one or more keys 212 may include a recess formed radially therethrough. The spring 212*s* may be at least partially disposed in the corresponding recess.

Each of the one or more keys 212 may include a tab. The threaded body cylinder 216 may be configured to engage the tab of the corresponding key. The tab may be formed at an upper longitudinal end of the key. The tab may be disposed in an inner recess of the drive stem. The piston rod of the threaded body cylinder 216 may be configured to engage the tab. The drive stem 211 may include a flange 211*f* formed below the one or more keys 212. The flange 211*f* may include an upper shoulder. The one or more keys 212 may rest in the upper shoulder of the flange 211*f*. The upper shoulder of the flange 211*f* may support, the one or more keys 212. The upper shoulder of the flange 211*f* may be a pivot point for each of the one or more keys 212. The upper shoulder of the flange 211*f* may have a rounded surface. Each of the one or more keys 212 may include a rounded surface at a lower longitudinal end. The rounded surface of the upper shoulder may facilitate the movement of the one or more keys 212 between the extended position and the retracted position.

Figure 12:
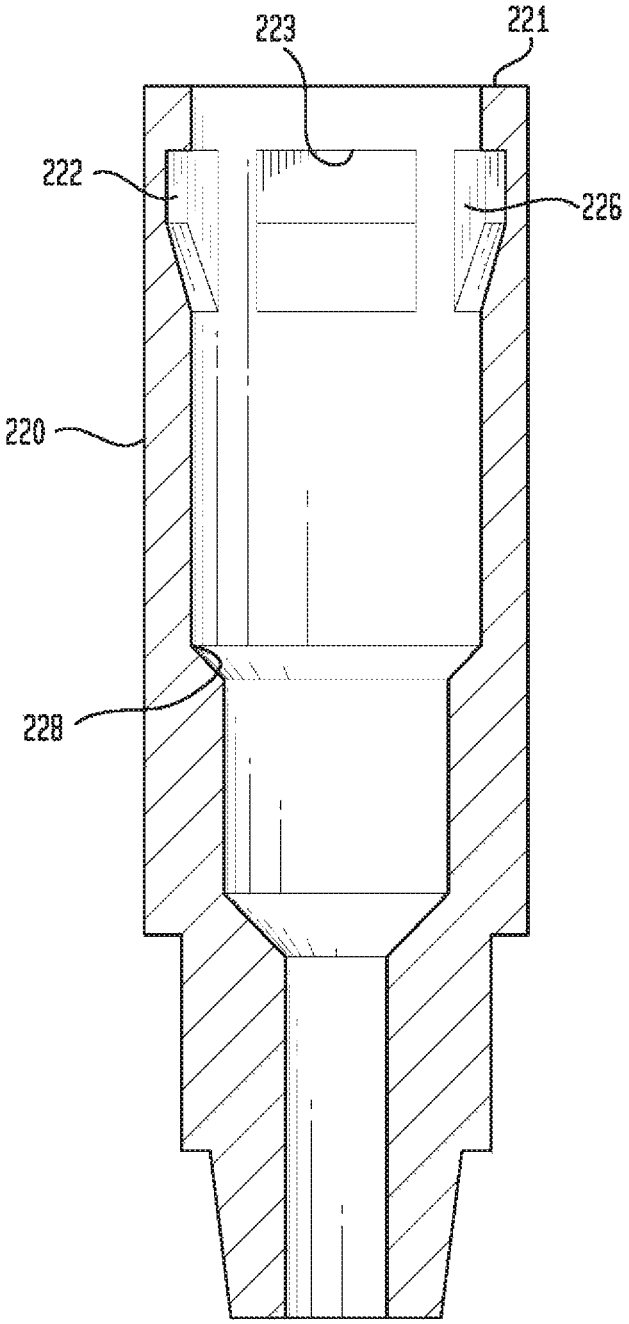
FIG. 12 illustrates a cross-sectional view of the adapter, according to the second embodiment.

FIG. 12 illustrates a cross-sectional view of the adapter 220. The adapter 220 may include one or more latch recesses, such as one or more key recesses 222, corresponding to the one or more keys 212 of the drive stem 211. The one or more key recesses 222 may be disposed in an inner surface of the adapter 220. The one or more key recesses 222 may be formed adjacent the bore of the adapter 220. The one or more key recesses 222 may be spaced circumferentially apart about an inner circumference of the adapter 220. The one or more key recesses 222 may be configured to receive a corresponding dog of the one or more keys 212. The alignment key 217 and slot 227 may be configured to facilitate alignment of the one or more keys 212 and the one or more key recesses 222. The one or more key recesses 222 may include a load profile 223 and a torque profile 226. The load profile 223 may be an upper shoulder of the corresponding key recess. The torque, profile 226 may be side walls of the corresponding key recess. The bore of the adapter 220 may include a stepped profile. The stepped profile may include a tapered surface 228. A lower edge of the tapered surface 228 may be configured to engage the seal 215.

Figure 13:
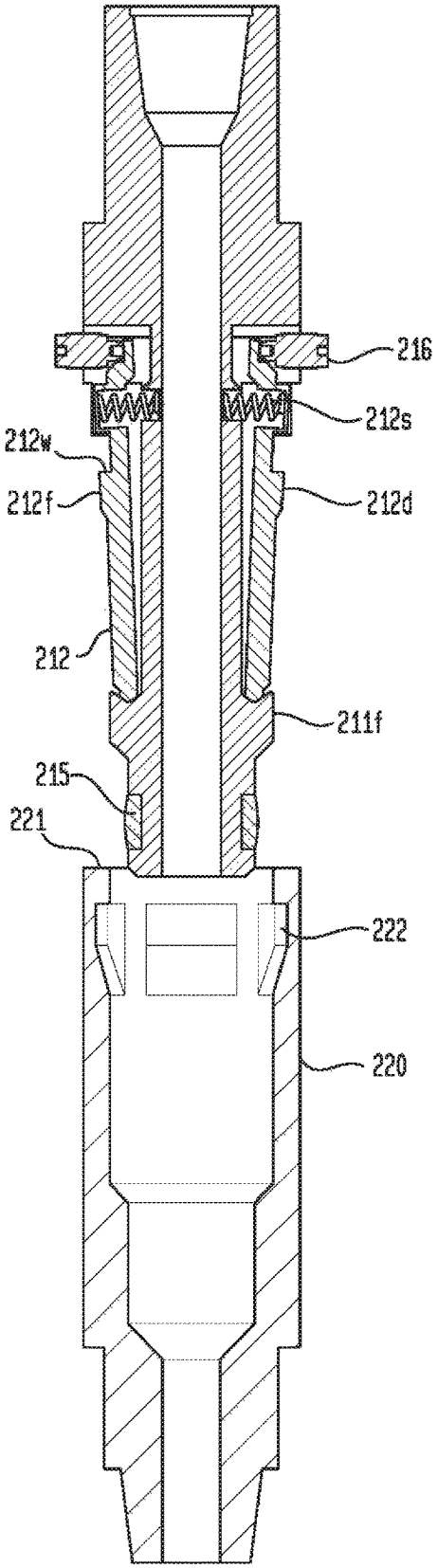
FIGS. 13-18 illustrate operation of the combined multi-coupler system, according to the second embodiment.

FIG. 13 illustrates insertion of the drive stem 211 in the bore of the adapter 220. The drive stem 211 may be rotated to align the alignment key 217 and the alignment key slot 227. As the drive stem 211 moves into the bore of the adapter 220, the alignment key 217 may enter the alignment key slot 227. The alignment key 217 and slot 227 ensure that dogs 212*d* of the one or more keys 212 are aligned with the one or more key recesses 222. The one or more keys 112 may be pivotally movable between the retracted position and the extended position. The threaded body cylinder 216 may be configured to overcome the biasing force of the spring 212*s* and move the corresponding key to the retracted position, shown in FIG. 18.

Each of the one or more keys 212 may include the dog 212*d*. The dog 212*d* may include the torque profile and the load profile 212*w*. The dog 212*d* may include a tapered surface 212*f* at a lower longitudinal end. The torque profile may be configured to torsionally couple the drive stem 211 and the adapter 220. The torque profile may be configured to provide bidirectional torque transfer between the drive stem 211 and the adapter 220. The load profile 212*w* may be configured to support a weight of the adapter 220 and the tool. The load profile 212*w* may be configured to longitudinally couple the drive stem 211 and the adapter 220.

Figure 14:
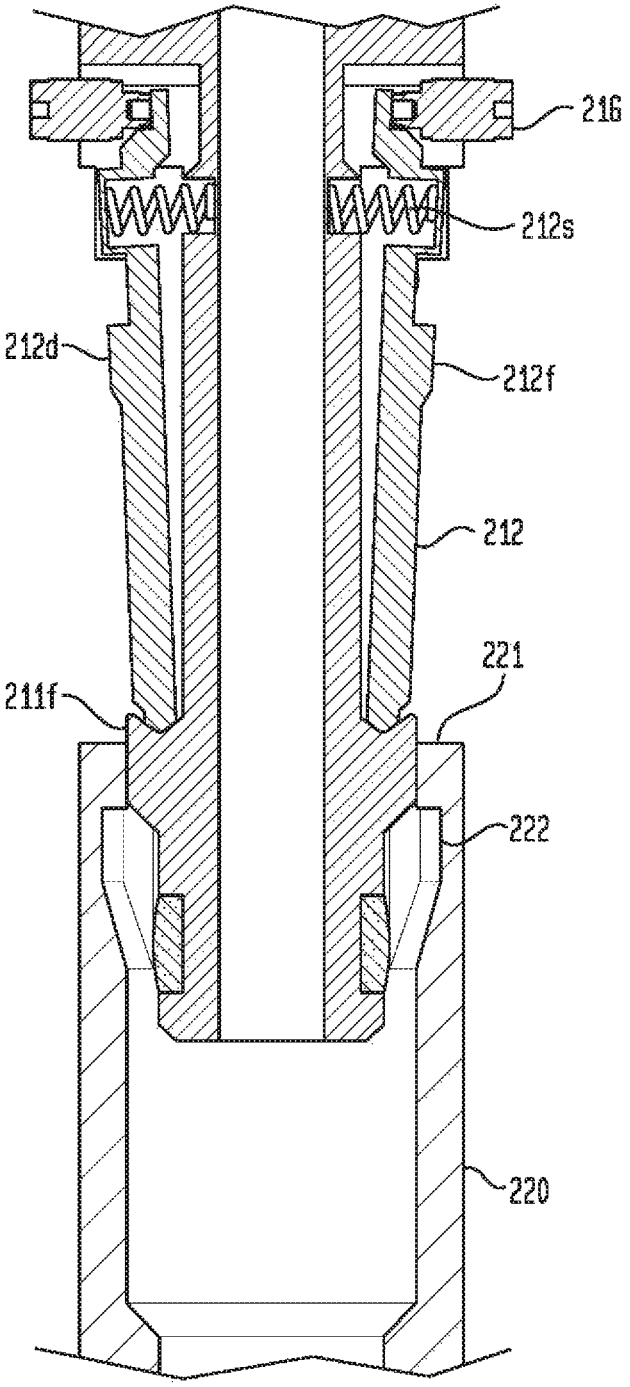
Figure 15:
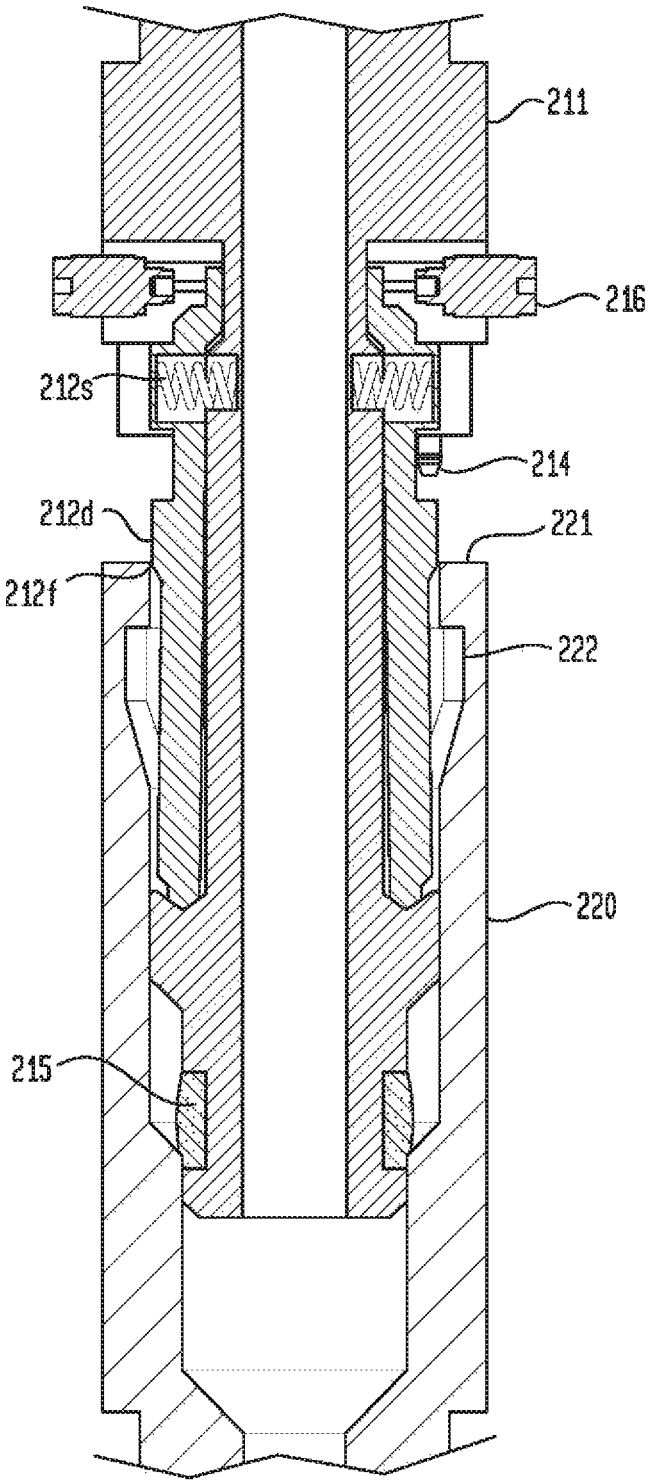

The CMC is operable to torsionally and longitudinally couple the drive stem 211 and the adapter 220. First, the drive stem 211 is inserted into the adapter 220, as shown in FIGS. 13-15. The drive stem 211 enters the bore of the adapter 220. The tapered surface of the lip 221 of the adapter 220 engages the tapered surface 212*f* of the dog 212*d*. The tapered surface of the lip 221 forces the dogs 212*d* to the retracted position during insertion of the drive stem 211. The force of the tapered surface of the lip 221 acting on the dog 212*d* overcomes the biasing force of the spring 212*s*. The seal 215 engages a lower longitudinal end of the tapered surface 228 and seals against the bore of the adapter 220.

Figure 16:
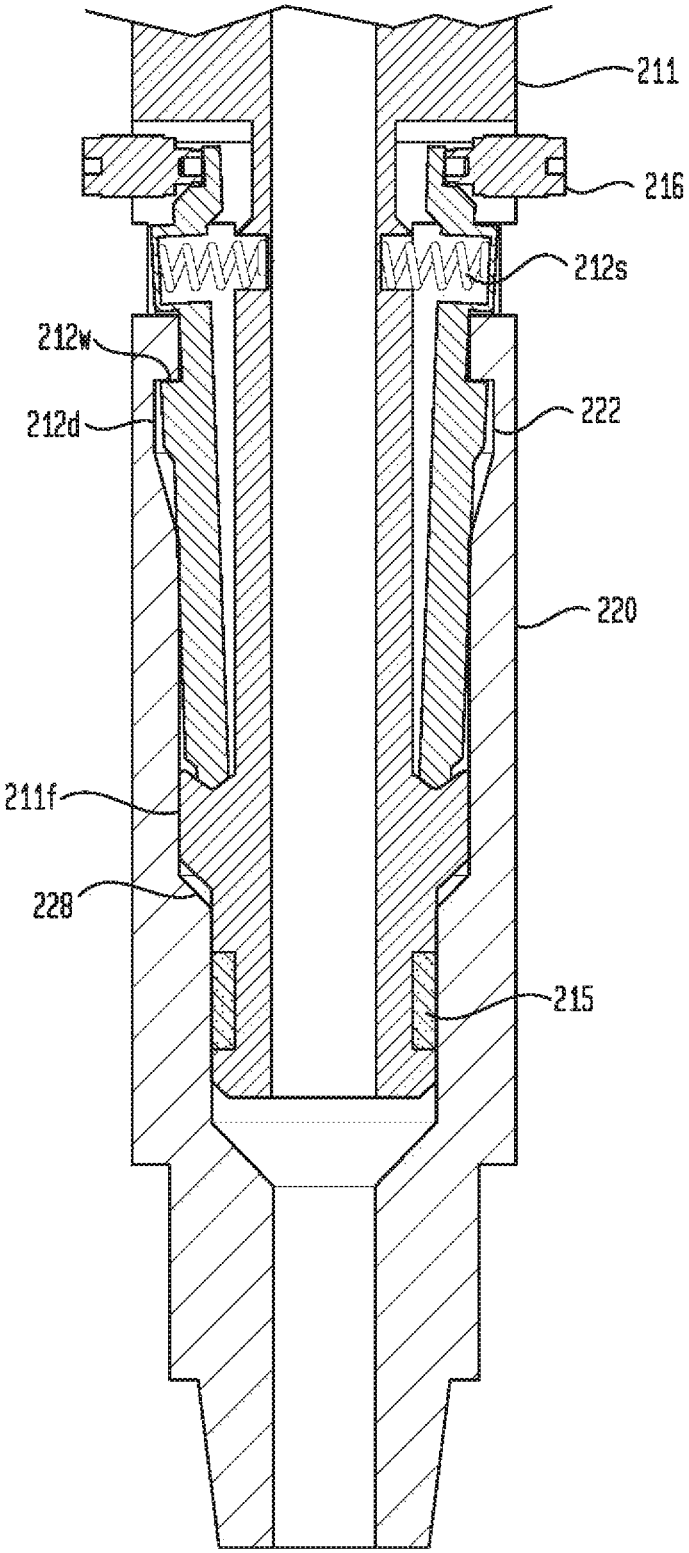

The drive stem 211 continues traveling into the bore of the adapter 220 until the dogs 212*d* are located adjacent the one or more key recesses 222, as shown in FIG. 16. The spring 212*s* biases the corresponding key towards the extended position, shown in FIG. 16. In the extended position, the dog 212*d* is disposed in the corresponding key recess. The torque profile of the dog 212*d* engages the torque profile 226 of the corresponding key recess to bidirectionally torsionally couple the adapter 220 and the drive stem 211. The load profile 212*w* engages the load profile 223 of the corresponding key recess to longitudinally couple the adapter 220 and the drive stem 211. The load profile 212*w* supports and transfers the weight of the adapter 220 and the tool to the drive stem 211. The one or more utility couplers 214 engage and connect to the one or more utility couplers 224. Engagement of the utility couplers 214, 224 provides transfer of power, data, electronic, hydraulics, and/or pneumatics between the drive stem 211 and the adapter 220. The seal 215 seals against the inner surface of the adapter 220.

Figure 17:
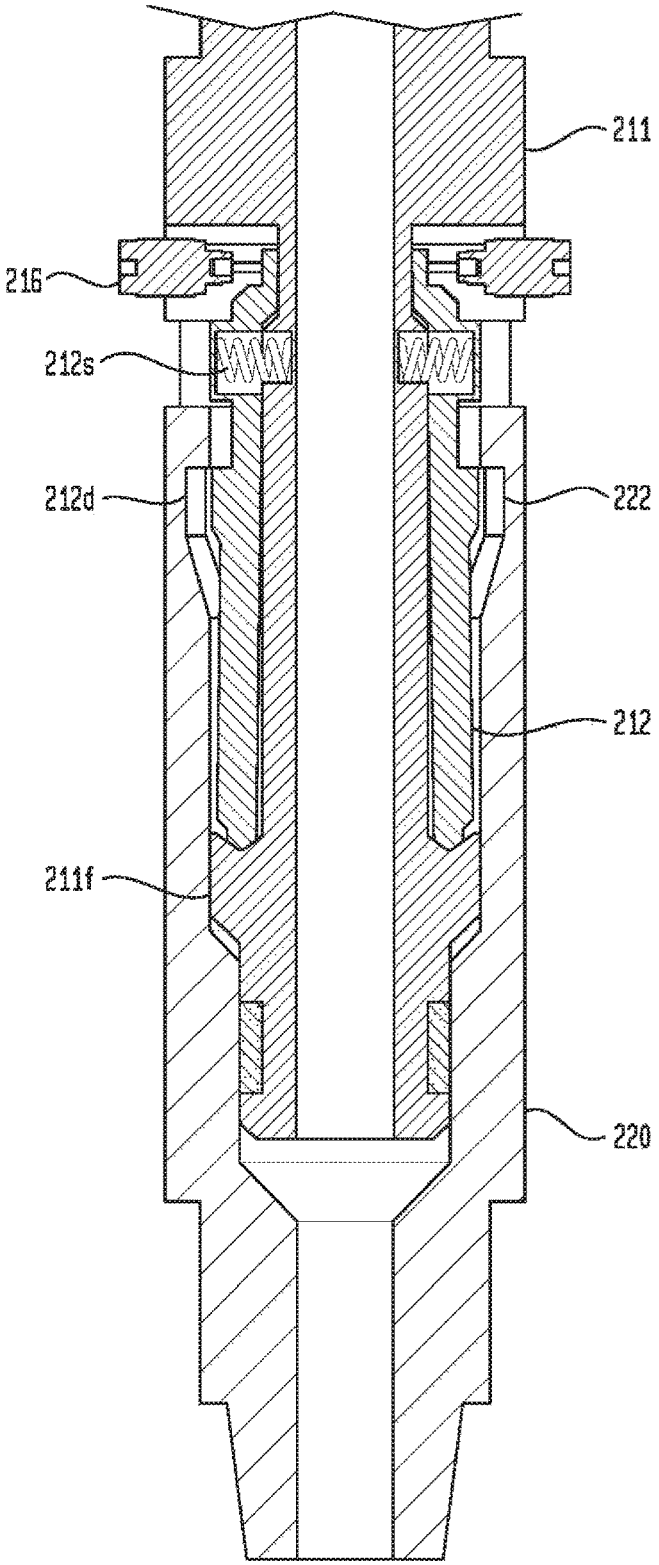
Figure 18:
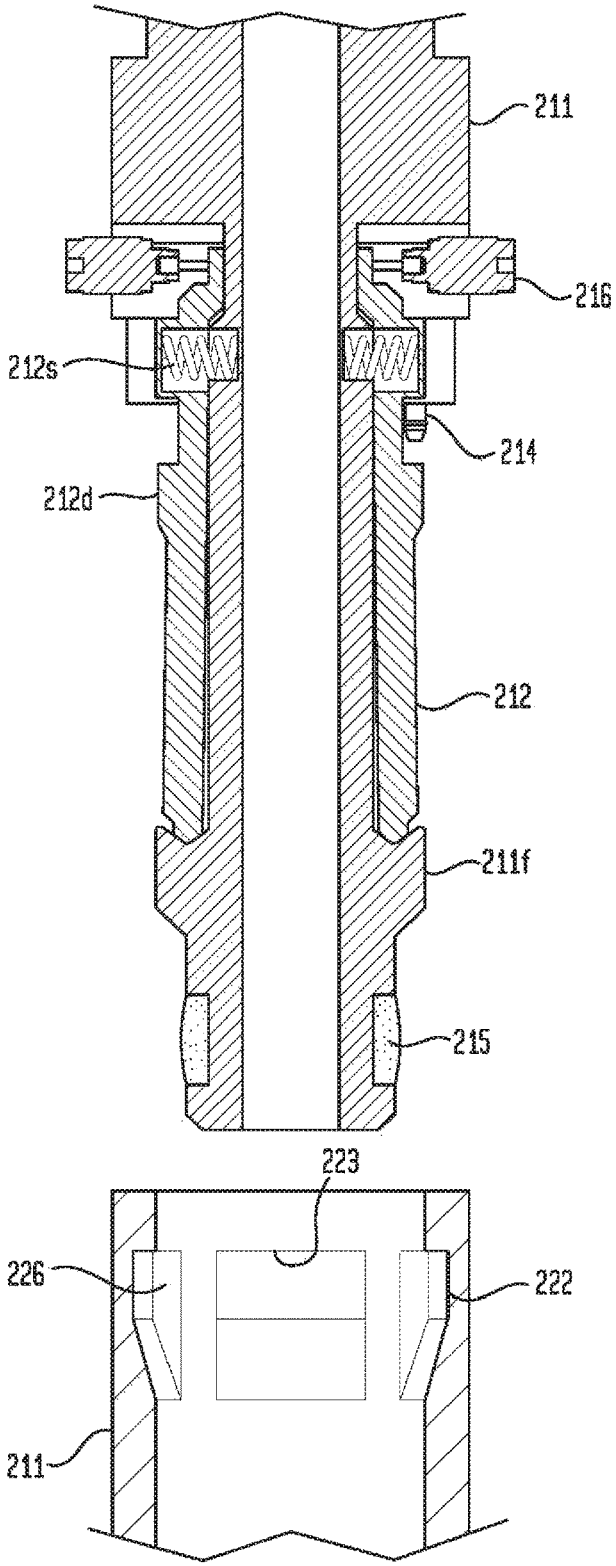

In order to decouple the adapter and the drive stem, the threaded body cylinder 216 is actuated to move the dog 212*d* out of the corresponding key recess, as shown in FIG. 17. The threaded body cylinder 216 pushes against the tab of the corresponding key. The one or more keys 212 pivot about the pivot point on the upper shoulder of the flange 211*f*, moving the corresponding dog 212*d* out of the corresponding key recess. The threaded body cylinder 216 moves the one or more keys 212 to the retracted position, shown in FIG. 17. Once disengaged, the drive stem 211 is removed from the bore of the adapter 220. As the drive stem 211 moves out of the adapter 220, the utility couplers 214, 224 disengage and disconnect. The alignment key 217 moves out of the alignment key slot 227 and the drive stem 211 and adapter 220 are decoupled, as shown in FIG. 18.

Alternatively, the threaded body cylinder 216 may be actuated to move the corresponding key to the retracted position during insertion of the drive stem 211 in the bore of the adapter 220. Once the drive stem 211 is fully inserted into the bore of the adapter 220 and the dogs 212*d* of the one or more keys 212 are aligned with the one or more key recesses 222, the threaded body cylinder 216 may be deactuated and the spring 212*s* may bias the dogs 212*d* into the extended position to engage with the one or more key recesses 222.

Figure 19:
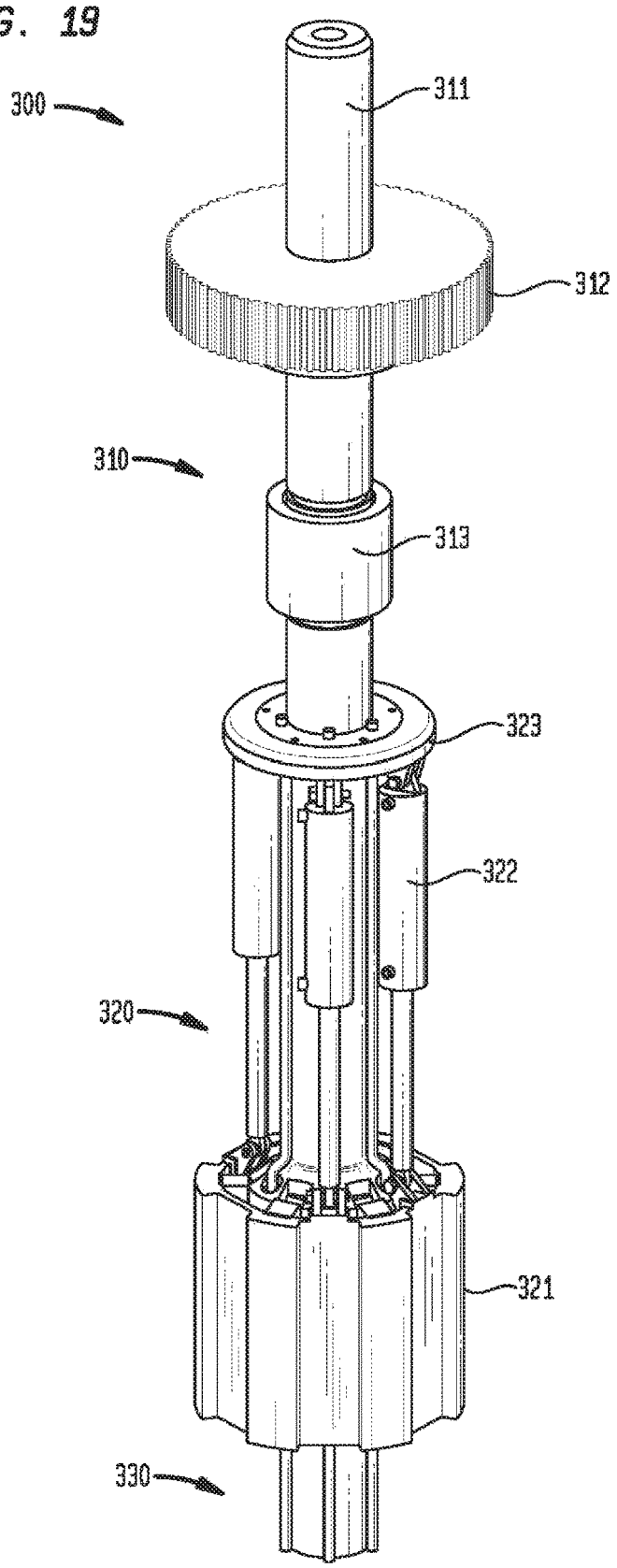
FIG. 19 illustrates an isometric view of a combined multi-coupler system, according to a third embodiment.

FIG. 19 illustrates a CMC 300 in a locked position, according to another embodiment. The CMC 300 includes a drive member 310 of a top drive, a coupling assembly 320, and an adapter 330 of a tool. The drive member 310 may include a drive stem 311. The drive stem 311 may be tubular having a bore therethrough. The drive stem 311 may be disposed in a housing of the top drive. The drive stem 311 may be configured to connect to a supply line at an upper longitudinal end. The bore of the drive stem 311 may pass fluid, such as drilling fluid, from the supply line to the adapter 330 of the tool. The drive stem 311 may include a gear section 312 and a utility transfer assembly 313. The gear section 312 may be integrally formed with the drive stem 311. The gear section 312 may extend radially outward from the drive stem 311. The gear section 312 may include gear teeth on an outer circumference. The gear section 312 may be configured to rotate the drive stem 311 relative to the housing of the top drive. The gear section 312 may be configured to engage an actuator, such as a motor. The motor may include gear teeth corresponding to and configured to engage the gear teeth of the gear section 312. The gear section 312 may be configured to transfer torque from the motor to the drive stem 311. The motor may be configured to rotate the drive stem 311 relative to the housing.

The utility transfer assembly 313 may be disposed on the drive stem 311. The utility transfer assembly 313 may be disposed about a circumference of the drive stem. The utility transfer assembly 313 may be configured to transfer power, data, electronic, hydraulics, and/or pneumatics between stationary and rotational parts of the top drive, such as between the housing and the drive stem 311. The utility transfer assembly 313 may include a slip ring assembly and/or a hydraulic swivel. The slip ring assembly may include a ring member having one or more contact rings (such as copper rings) that rotate with the drive stem 311. The slip ring assembly may include a support housing for supporting one or more contact members (such as brushes) that are non-rotatively coupled to the housing of the drive member 310. The non-rotating contact members contact the contact rings of the rotating ring member, thereby providing an electrical connection across a rotating interface. In this manner, electronic signals may be sent between the stationary and rotational parts of the top drive. Additionally, the hydraulic swivel of the utility transfer assembly 313 may provide transfer of hydraulic fluids for pneumatic and/or hydraulic operation of the tool.

The coupling assembly 320 includes a lock sleeve 321, one or more actuators, such as piston and cylinder assembly 322, and a bracket 323. The lock sleeve 321 may be tubular having a bore therethrough. The lock sleeve 321 may be disposed about the drive stem 311. The lock sleeve 321 may be longitudinally movable relative to the drive stem 311 between an upper position, shown in FIG. 28, and a lower position, shown in FIG. 29. The piston and cylinder assembly 322 may be configured to move the lock sleeve 321 longitudinally relative to the drive stem 311. The piston and cylinder assembly 322 may be connected to the bracket 323 at an upper longitudinal end. The piston and cylinder assembly 322 may be connected to the lock sleeve 321 at an opposite longitudinal end. Alternatively, the piston and cylinder assembly 322 may be replaced with any linear actuator. Supply lines from the utility transfer assembly 313 may connect to the piston and cylinder assembly 322 to provide hydraulic fluid to operate the piston and cylinder assembly 322. The bracket 323 may be an annular disk with a bore therethrough. The bracket 323 may be made of two or more sections fastened together to form a ring. The bracket 323 may be disposed about the drive stem 311. The bracket 323 may include fasteners to connect the bracket 323 to the drive stem 311. The bracket 323 may include one or more flanges. The one or more flanges may receive fasteners, such as bolts, to connect the piston and cylinder assembly 322 to the bracket 323. The bracket 323 may support and connect the coupling assembly 320 to the drive stem 311.

Figure 20:
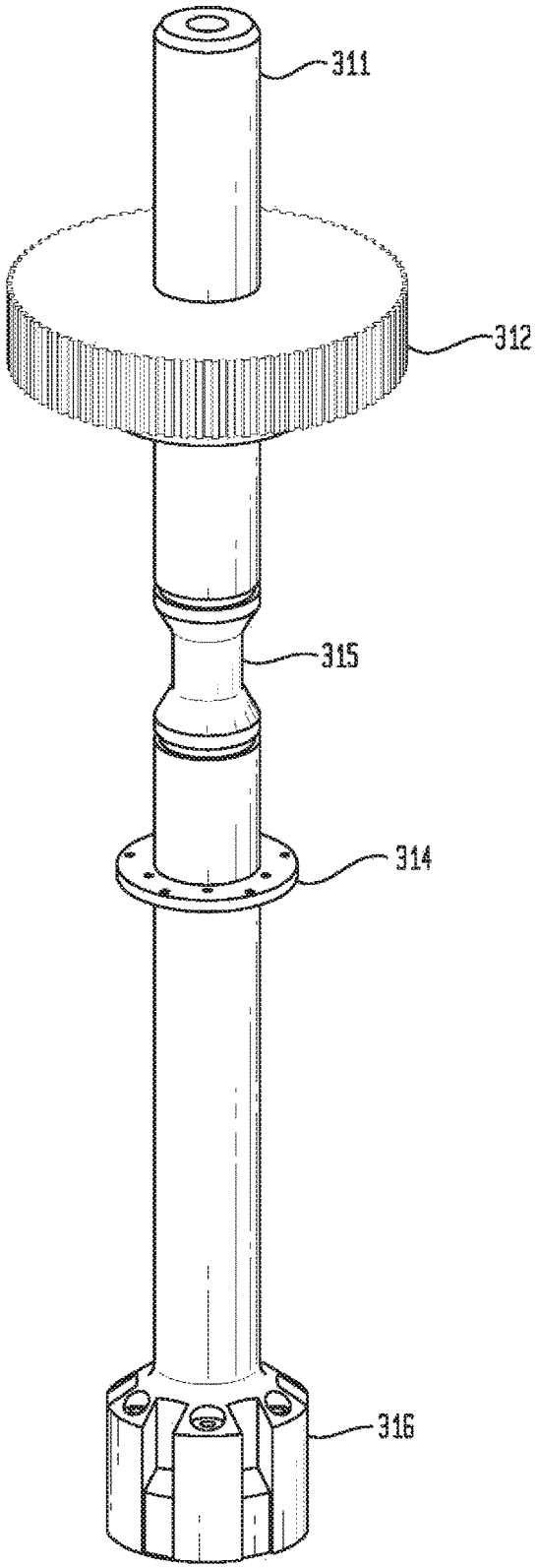
FIG. 20 illustrates a drive stem of a combined multi-coupler system, according to the third embodiment.

FIG. 20 illustrates the drive stem 311, with the coupling assembly 320 and the utility transfer assembly 313 removed. The drive stem 311 may include a torque sub area 315, a frame 314, and a connection profile 316. The torque sub area 315 may be disposed longitudinally below the gear section 312. The drive stem 311 may taper radially inward to the torque sub area 315. The circumference of the torque sub area 315 may be smaller than the circumference of the drive stem 311. The torque sub area 315 may include one or more torque sensors, such as strain gauges. The one or more torque sensors may be disposed on an outer surface of the torque sub area 315. The one or more torque sensors may be configured to measure an amount of torque exerted on the drive stem 311. The one or more torque sensors may be configured to measure the amount of torque during makeup of a threaded connection with the tubular string. The utility transfer assembly 313 may be disposed over the torque sub area 315. The utility transfer assembly 313 may be configured to receive signals and data from the one or more torque sensors. The utility transfer assembly 313 may be configured to transfer the signals and data between the stationary and rotational parts of the top drive. The frame 314 may be disposed about a circumference of the drive stem 311. The frame 314 may be integrally formed with the drive stem 311. The frame 314 may extend radially outward from the drive stem 311. The frame 314 may be circular. The frame 314 may include one or more holes. The one or more holes may be longitudinally formed through the frame 314. The one or more holes may be threaded. The frame 314 may be configured to support the bracket 323. The bracket 323 may be coupled to the frame 314 by threaded fasteners.

Figure 21:
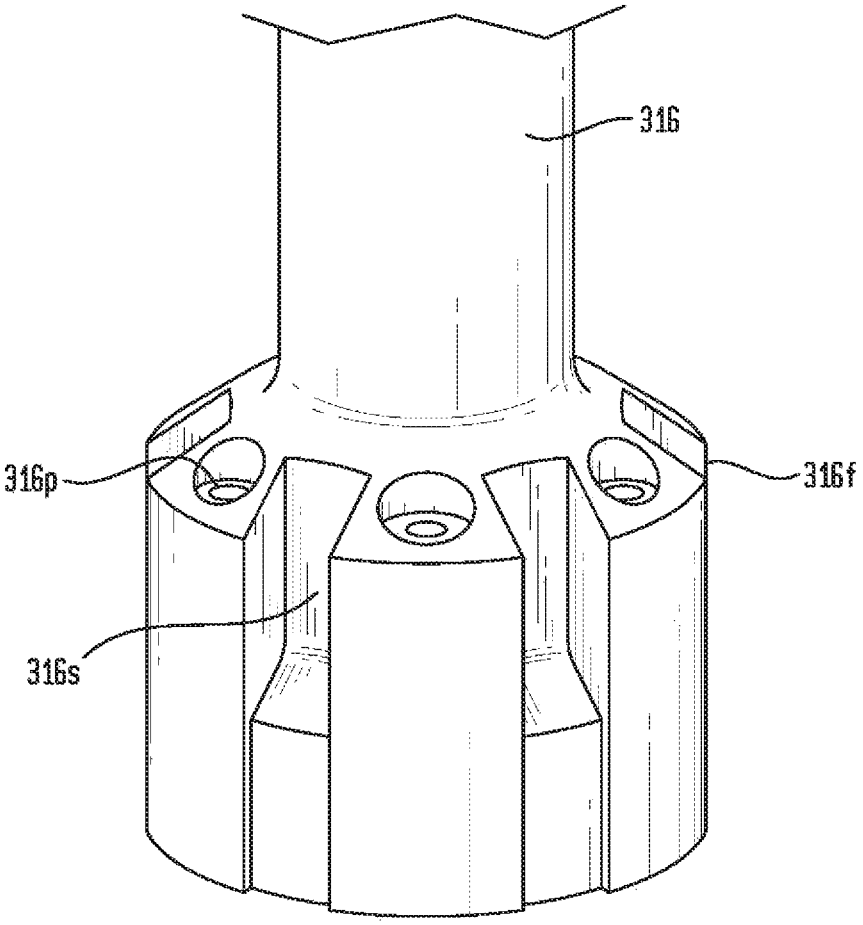
FIG. 21 illustrates a connection, profile of a combined multi-coupler system, according, to the third embodiment.

FIG. 21 illustrates the connection profile 316 of the drive stem 311. The connection profile 316 may be formed at a lower longitudinal end of the drive stem 311. The connection profile 316 may be integrally formed with the drive stem 311. One or more flanges 316*f* may be formed about a circumference of the connection profile 316. A port 316*p* may be formed longitudinally through a corresponding flange. The port 316*p* may be configured to connect to a corresponding utility line. A load profile 316*s* may be disposed between adjacent flanges. The load profile 316*s* may taper radially inward from an outer surface of the flange 316*f*. The load profile 316*s* may extend longitudinally upward along an outer surface of the connection profile 316.

Figure 22:
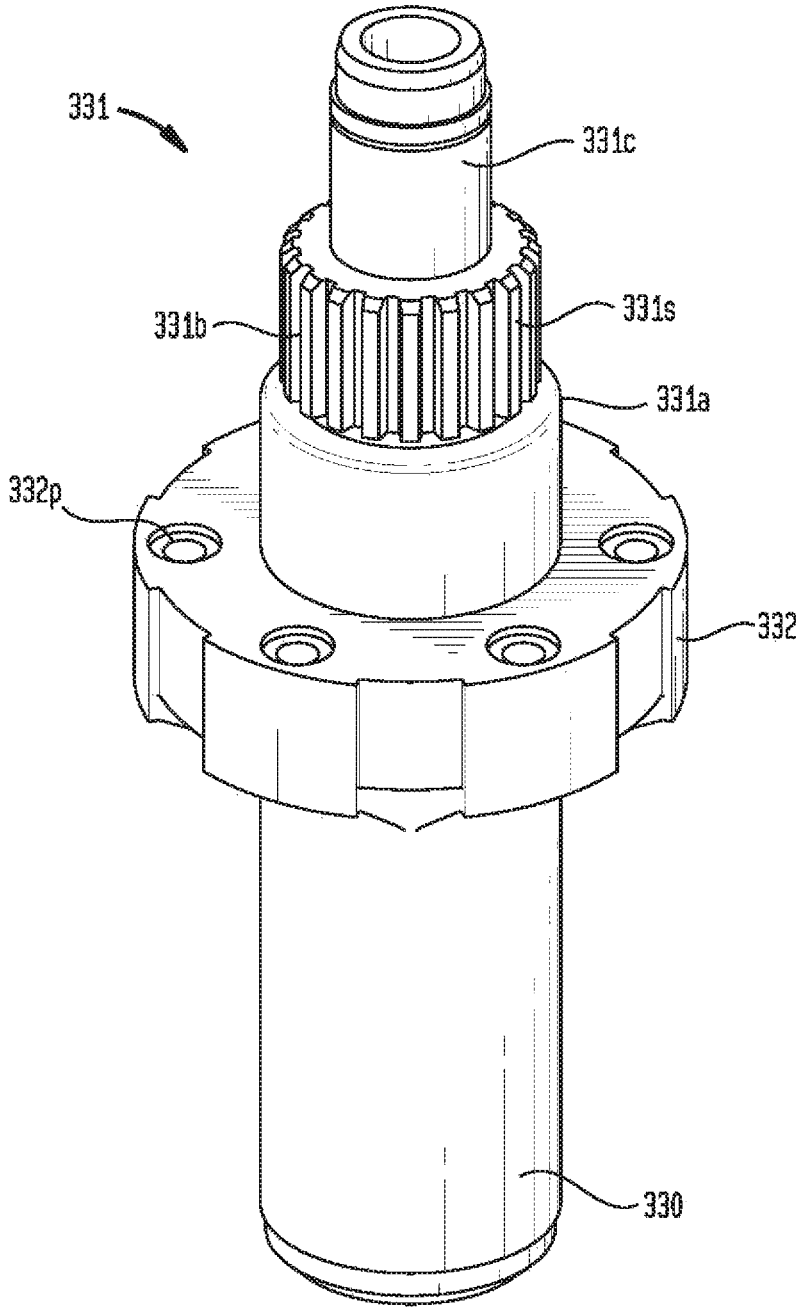
FIG. 22 illustrates an adapter of a tool, according to the third embodiment.

FIG. 22 illustrates the adapter 330 of the tool, The adapter housing 330 may be tubular having a bore therethrough. The adapter 330 may be integrally formed with the tool. The adapter 330 may be disposed at an upper longitudinal end of the tool. The adapter 330 may include a stepped profile 331 and a flange 332. The stepped profile 331 may be integrally formed with the adapter 330. The stepped profile 331 may include one or more annular shoulders 331*a-c*. The annular shoulder 331*a* may be formed directly above the flange 332. The annular shoulder 331*a* may extend longitudinally upwards from the flange 332. The annular shoulder 331*a* may have a circumference smaller than a circumference of the flange 332. The annular shoulder 331*b* may be formed directly above the annular shoulder 331*a*. The annular shoulder 331*b* may extend longitudinally upwards from the annular shoulder 331*a*. The annular shoulder 331*b* may have a circumference smaller than a circumference of the annular shoulder 331*a*. The annular shoulder 331*b* may include a torque profile. The torque profile may include splines 331*s*. The splines 331*s* may be configured to provide bidirectional torsional coupling of the drive stem 311 and the adapter 330. The annular shoulder 331*c* may be formed directly above the annular shoulder 331*b*. The annular shoulder 331*c* may extend longitudinally upwards from the annular shoulder 331*b*. The annular shoulder 331*c* may have a circumference smaller than the circumference of the annular shoulder 331*b*.

The flange 332 may be formed about a circumference of the adapter 330. The flange 332 may extend radially outward from the adapter 330. The flange 332 may be disposed below the stepped profile 331. The flange 332 may include one or more ports 332*p*. The one or more ports 332*p* may be formed longitudinally through an upper surface of the flange. The one or more ports 332*p* may be spaced circumferentially about the flange 332.

Figure 23:
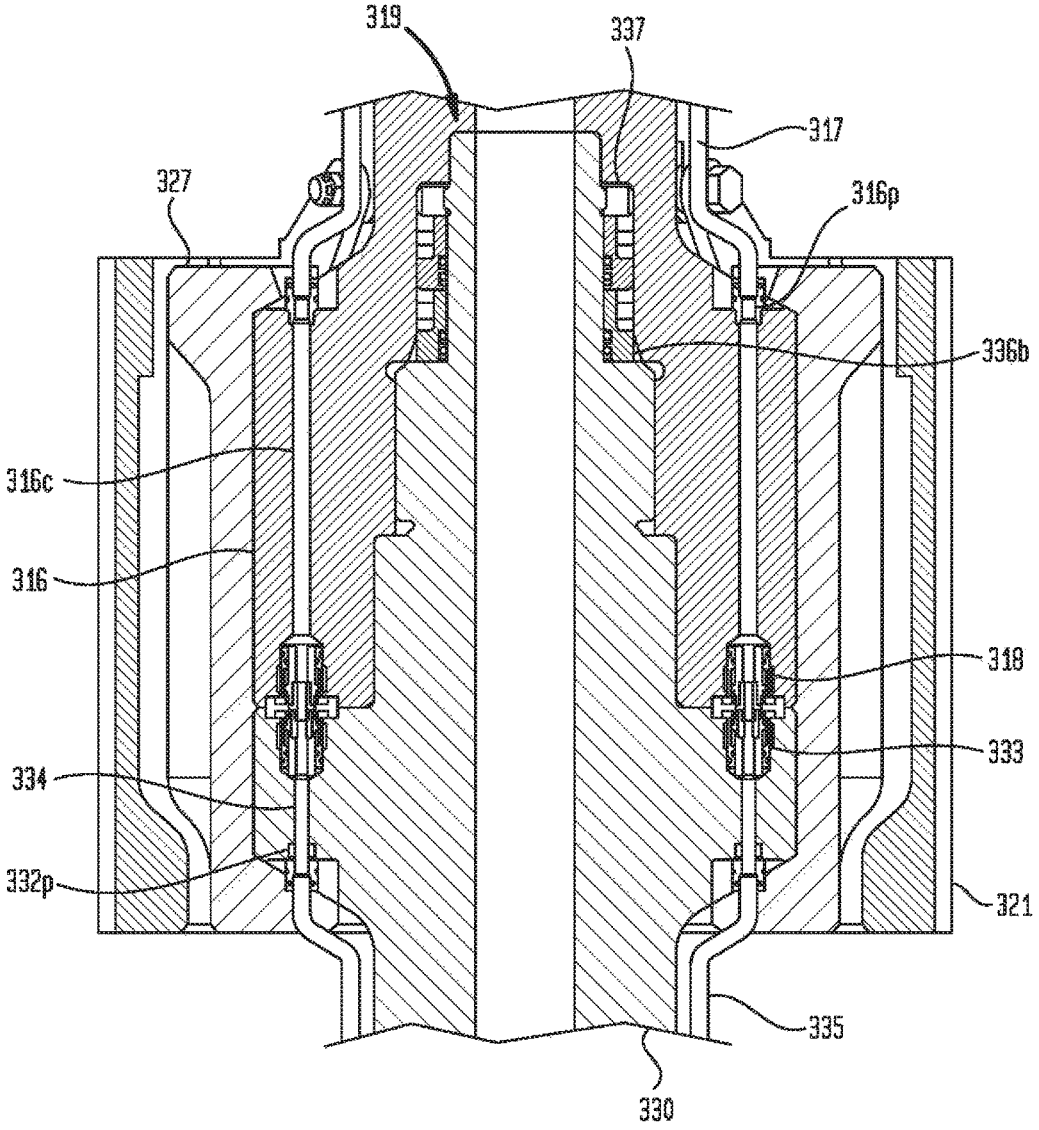
FIG. 23 illustrates a cross-sectional view of the combined multi-coupler system, according to the third embodiment.
Figure 24:
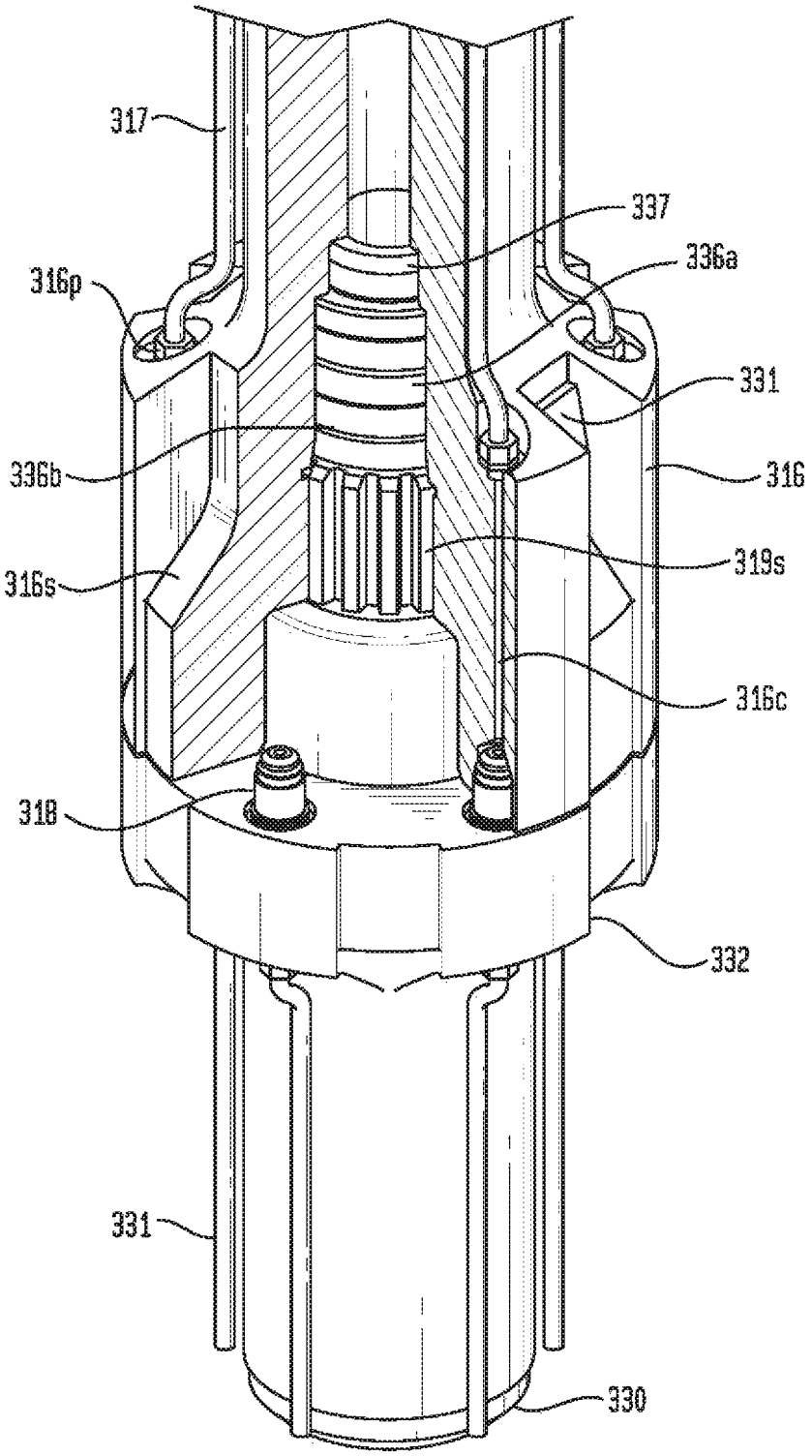
FIG. 24 illustrates a cross-sectional view of the drive stem and the adapter, according to the third embodiment.

FIGS. 23 and 24 illustrate the adapter 330 of the tool inserted into the drive stem 311. The connection profile 316 may include an inner stepped recess 319. The inner stepped recess 319 may be longitudinally aligned with the bore of the drive stem 311. The inner stepped recess 319 may extend from a lower longitudinal end of the bore of the drive stem 311 to the lower longitudinal end of the drive stem. The inner stepped recess 319 may be configured to receive the adapter 330 of the tool. The inner stepped recess 319 may include one or more shoulders. At least one of the one or more shoulders may include a splined surface 319*s*. The splined surface 319*s* may be formed on an inner surface, of the corresponding shoulder.

The connection profile 316 may include one or more ports, such as port 316*p*, one or more channels, such as channel 316*c*, and one or more utility couplers 318. A supply line 317 may be configured to transfer at least one of power, data, electric, hydraulics, and/or pneumatics between the utility transfer assembly 313 and the port 316*p*. An upper longitudinal end of the supply line 317 may be connected to the utility transfer assembly 313. An opposite longitudinal end of the supply line 317 may be connected to the port 316*p*. The channel 316*c* may be formed through a corresponding flange of the connection profile 316. The channel 316*c* may longitudinally extend downward through the flange from the port 316*p*. The channel 316*c* may connect to the utility coupler 318 at an opposite longitudinal end from the port 316*p*. The one or more utility couplers may be disposed in corresponding recesses formed in a lower longitudinal surface of the connection profile 316. The one or more utility couplers may be configured to receive and transfer at least one of power, data, electric, hydraulics, and/or pneumatics. The one or more utility couplers may be at least partially disposed within the drive stem 311. Each utility coupler may include a biasing member, such as a spring. The biasing member may be configured to compensate for misalignment of the drive stem 311 and the adapter 330.

The adapter 330 may include one or more utility couplers 333. The one or more utility couplers 333 may be disposed in corresponding recesses of the flange 332. The one or more utility couplers 333 may be similar to the one or more utility couplers 318. The one or more utility couplers 333 may be configured to engage the one or more utility couplers 318. The one or more utility couplers 333 may be at least partially disposed in the flange 332 of the adapter 330. Each utility coupler may include a biasing member, such as a spring. The biasing member may be configured to compensate for misalignment of the, drive stem 311 and the adapter 330. A channel 334 may be formed through the flange 332. The channel 334 may be formed longitudinally through the flange 332. The channel 334 may connect at one end to a corresponding utility coupler of the adapter 330. The channel 334 may connect at an opposite end to a corresponding supply line of the tool. One or more supply lines 335 may be configured to transfer power, data, electronics, hydraulics, and/or pneumatics to components of the tool.

The annular shoulder 331*c* may be configured to receive a seal package. The seal package may include a main seal 336*a*, a backup seal 336*b*, and a locking nut 337. The seal package may be disposed about a circumference of the adapter. The seal package may engage and seal against an outer surface of the adapter 330 and an inner surface of the drive stem 311. The seal package may be configured to prevent fluid, such as drilling fluid, from leaking between the adapter 330 and the drive stern 311. The locking nut 337 may be threadedly attached to the adapter 330. The locking nut 337 may retain the main seal 336*a* and the backup seal 336*b* on the adapter 330. The locking nut 337 may be removable to allow for replacement of the main seal 336*a* and/or the backup seal 336*b*. The main seal 336*a* may be disposed about the circumference of the adapter 330. The main seal 336*a* may be an annular seal. The main seal 336*a* may be configured to engage, and seal against the outer surface of the adapter 330 and the inner surface of the drive stem 311. The main seal 336*a* may be removable and replaceable. The backup seal 336*b* may be similar to the main seal 336*a*. The backup seal 336*b* may be an annular seal. The backup seal 336*b* may be configured to engage and seal against the outer surface of the adapter 330 and the inner surface of the drive stem 311. The backup seal 336*b* may be removable and replaceable. In order to remove and/or replace a damaged or worn seal, the locking nut 337 is removed from the adapter 330. The locking nut 337 may be unscrewed from the adapter 330. The damaged or worn seal may be slid off an upper longitudinal end of the adapter 330. A replacement seal may be slide down over the end of the adapter 330. The locking nut 337 may be screwed back onto the threads of the adapter 330 to retain the replacement seal in place. Either or both of the main seal 336*a* and the backup seal 336*b* may be replaced.

FIG. 24 illustrates a partial cutaway of the adapter 330 inserted into the drive stem 311 with the coupling assembly 320 removed. The annular shoulder 331*b* may include a torque profile. The torque profile may include splines 331*s*. The splines 331*s* may be configured to engage the splined surface 319*s* of the corresponding shoulder of the inner recess 319 to torsionally couple the adapter 330 and the drive stem 311.

Figure 25:
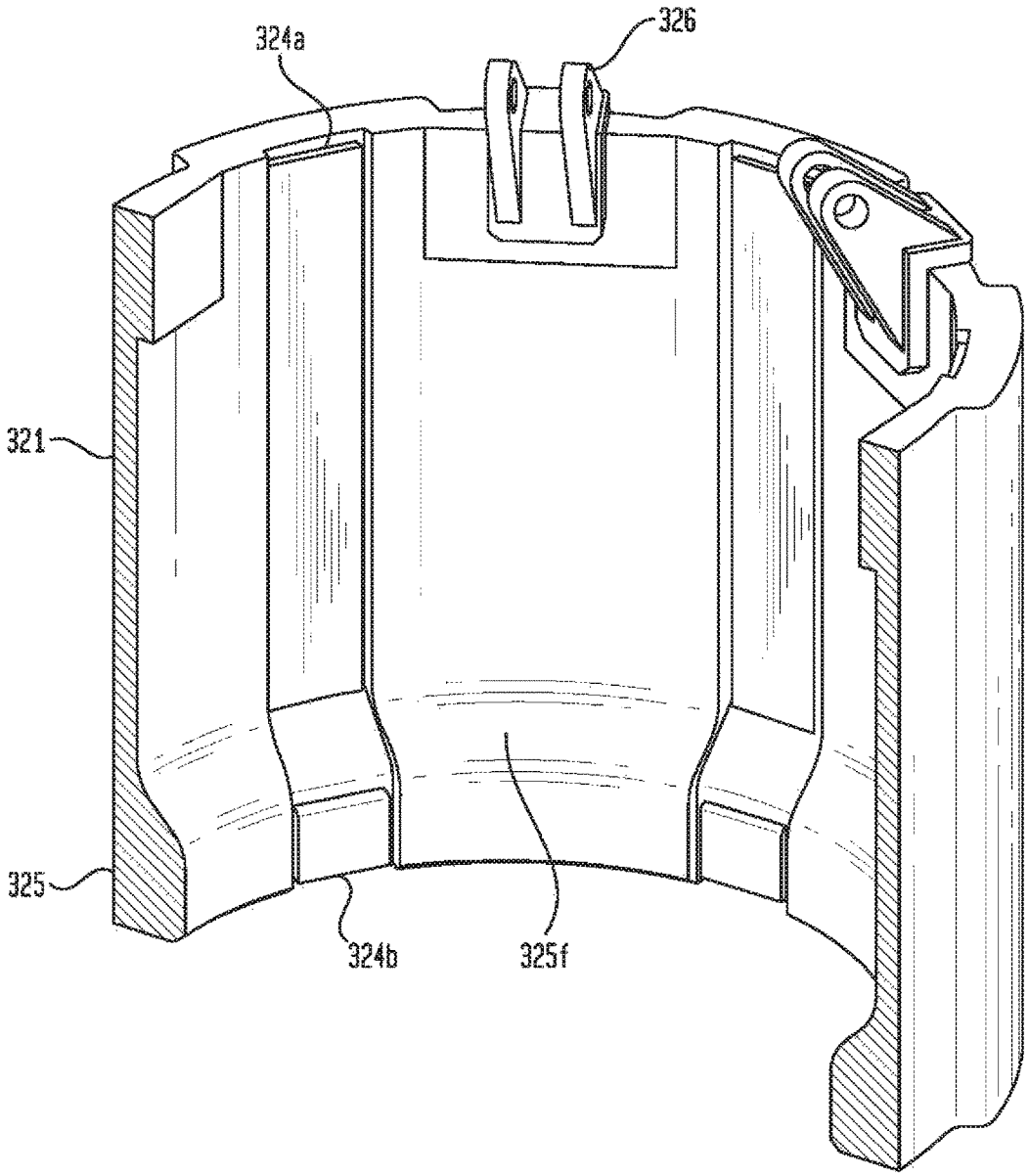
FIG. 25 illustrates a cross-sectional view of a lock sleeve, according to the third embodiment.

FIG. 25 illustrates a partial cutaway of the lock sleeve 321. The lock sleeve 321 may include one or more load plates 324, a flange 325, and a hinge 326. The one or more load plates 324 may be configured to engage one or more locking, members, such as locking clamps. The one or more load plates 324 may include a first section 324*a* and a second section 324*b*. The first section 324*a* may be disposed on an inner surface of the lock sleeve 321 facing the drive stem 311. The first section 324*a* may extend longitudinally upwards from the flange 325 of the lock sleeve 321. The second section 324*b* may be disposed on an inner surface of the flange 325 of the lock sleeve 321 facing the drive stem 311. The flange 325 may extend about an inner circumference of the lock sleeve 321. The flange 325 may extend radially inward from the lock sleeve 321. The flange 325 may be integrally formed with the lock sleeve 321. The flange 325 may include a tapered surface 325*f*. The tapered surface 325*f* may be configured to engage the one or more locking members, such as locking clamps 327. The tapered surface 325*f* may engage the locking clamps 327 and pivot the locking clamps 327 between an unlocked position, shown in FIG. 26, and a locked position, shown in FIG. 27. The hinge 326 may be disposed at an upper longitudinal end of the lock sleeve 321. The hinge 326 may be configured to couple the lock sleeve 321 to the actuator, such as piston and cylinder assembly 322.

Figure 26:
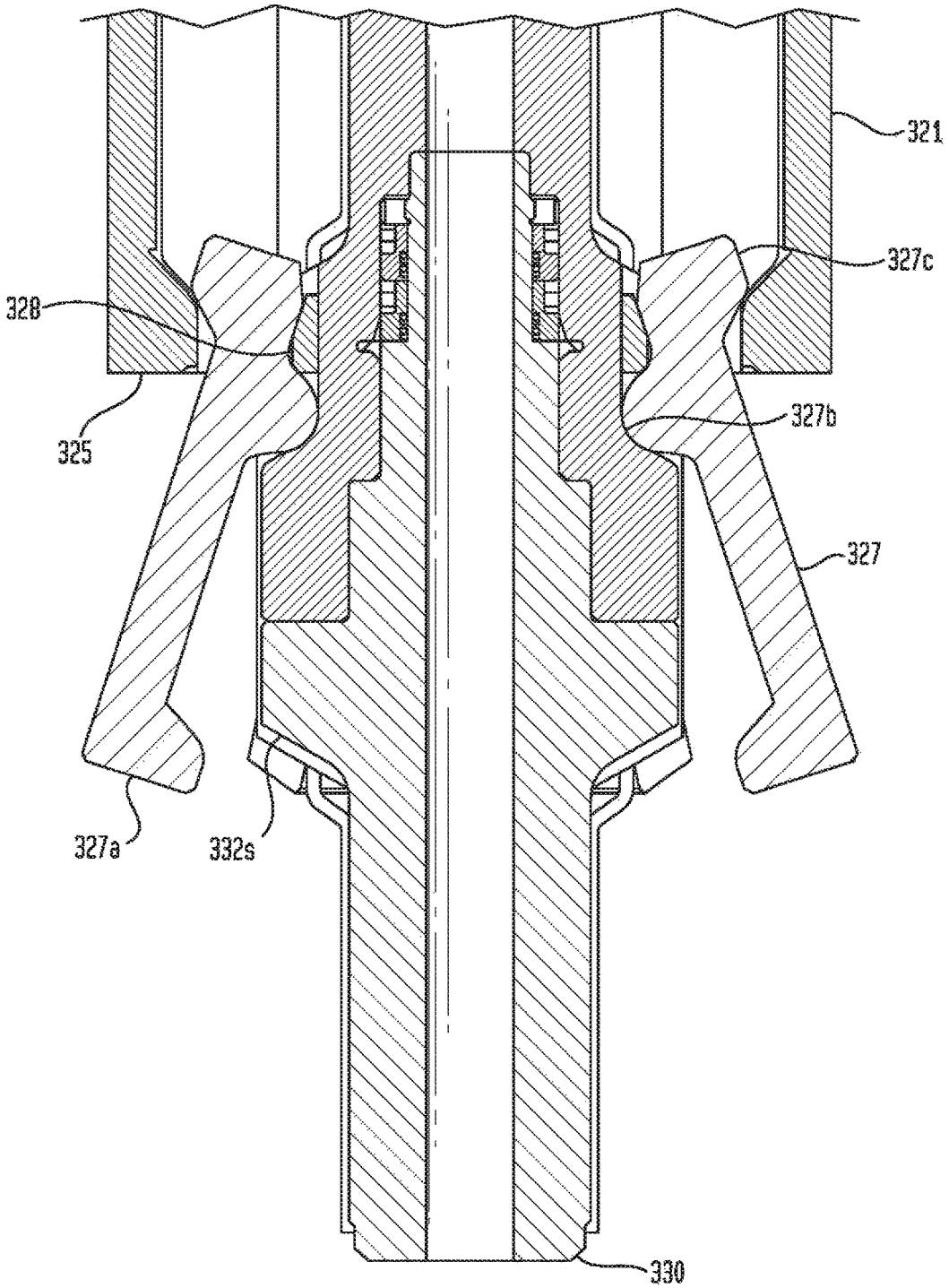
FIGS. 26-29 illustrate operation of the combined multi-coupler system, according to the third embodiment.
Figure 27:
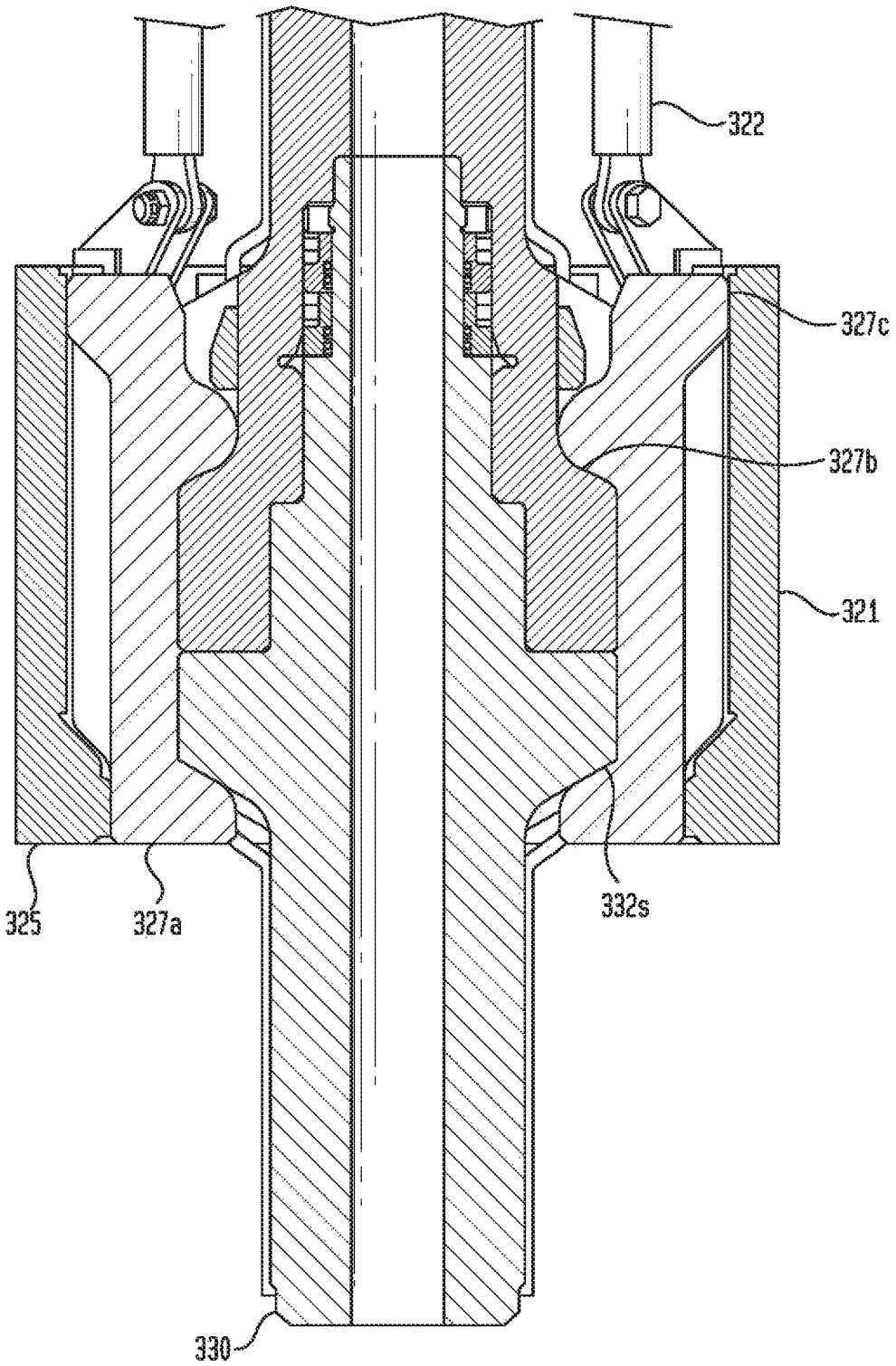

FIGS. 26 and 27 illustrate a cross-sectional view of the lock sleeve 321, the adapter 330, and the drive stem 311. The lock sleeve 321 may be configured to move the locking clamps 327 between the unlocked position and the locked position. FIG. 26 illustrates the locking clamps 327 in an unlocked position. The locking clamps 327 may be disposed on the load profile 316*s* of the connection profile 316. The locking clamps 327 may include an upper flange 327*c*, a turning profile 327*b*, and a lower flange 327*a*. A retaining member 328 may be disposed on an outer surface of the connection profile 316. The retaining member 328 may be configured to retain a corresponding locking clamp in the load profile 316*s*. The retaining member 328 may restrict longitudinal movement of the corresponding locking clamp. The retaining member 328 may be fastened to the outer surface of the connection profile 316. The flange 325 of the lock sleeve 321 may be configured to engage the upper flange 327*c* and move the corresponding locking clamp to the unlocked position. Engagement of the upper flange 327*c* with the flange 325 of the lock sleeve 321 causes the corresponding locking clamp to pivot about the turning profile 327*b*. The turning profile 327*b* pivots relative to the load profile 316*s*, extending away from the adapter 330. The lock sleeve 321 may be configured to engage and retain the locking clamps 327 in the unlocked position. The flange 325 of the lock sleeve 321 engages the flange 327*c*, preventing further movement of the locking clamps 327.

The lock sleeve 321 may be lowered by the piston and cylinder assembly 322 to move the locking clamps 327 to the locked position, shown in FIG. 27. The flange 325 of the lock sleeve 321 may engage the locking clamps 327. As the lock sleeve 321 moves downward, the flange 325 causes the locking clamps 327 to pivot about the turning profile 327*b*. The turning profile 327*b* pivots relative to the load profile 316*s*. The flange 327*a* pivots into engagement with a load shoulder 332*s* of the adapter 330, as shown in FIG. 27. In the locked position, the locking clamps 327 longitudinally couple the adapter 330 and the drive stem 311. The lock sleeve 321 may be configured to engage and retain the locking clamps 327 in the locked position. Engagement of the lower flange 327*a* with the flange 325 and the upper flange 327*c* with the lock sleeve 321 restricts further movement, of the locking clamps 327.

Figure 28:
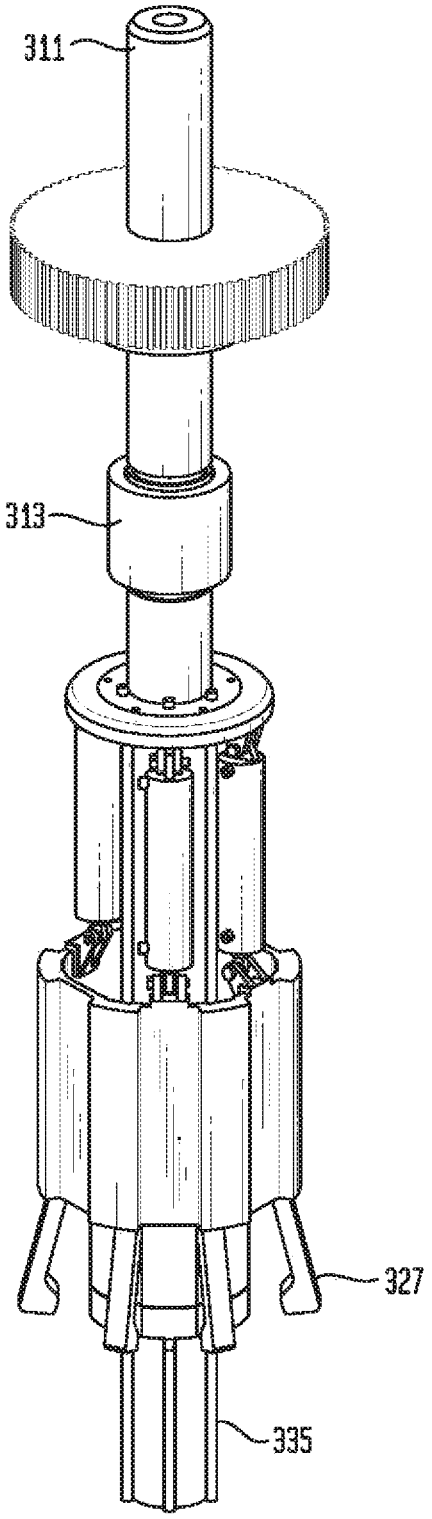
Figure 29:
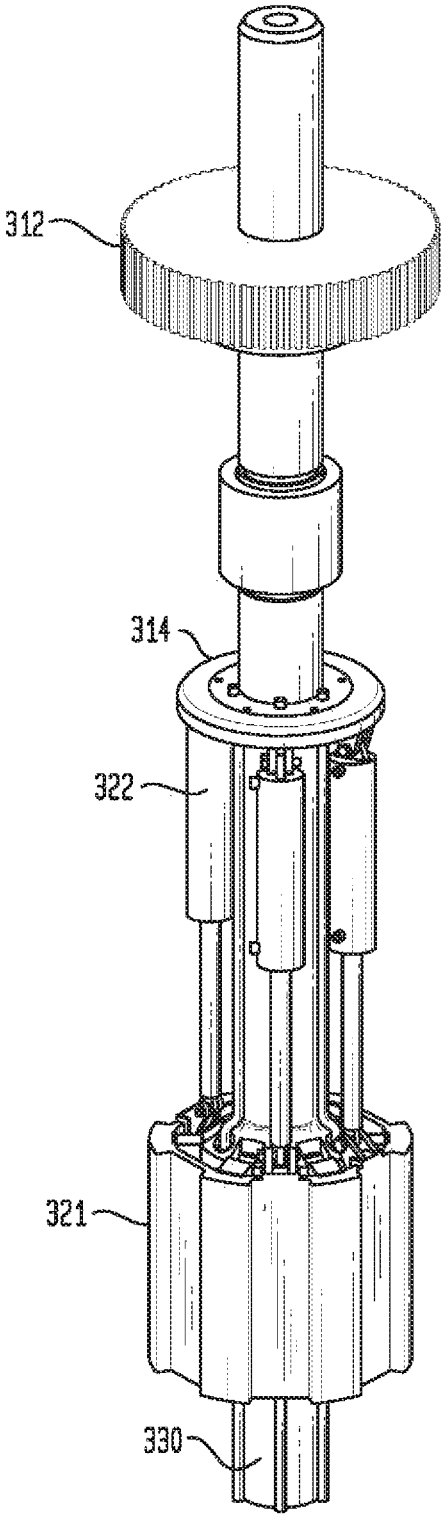

FIGS. 28 and 29 illustrate operation of the CMC 300. First, the stepped profile 331 of the adapter 330 is inserted into the stepped recess 319 of the drive stem 311. The adapter 330 moves through the stepped recess 319 until the flange 332 engages a lower end of the drive stem 311. The seal package engages and seals against an inner surface of the drive stem 311. The splines 331*s* engage the splined surface 319*s*, thereby bidirectionally torsionally coupling the drive stem 311 and the adapter 330. The utility couplers 318 engage and connect to the utility couplers 333. The lock sleeve 321 is in the upper position, as shown in FIG. 28. Next, the lock sleeve 321 is actuated to longitudinally couple and lock the drive stem 311 and the adapter 330 FIGS. 27 and 29 illustrates the locking clamps 327 in the locked position and the lock sleeve 321 in the lower position. The piston and cylinder assembly 322 is actuated to move the locking sleeve 321 into the lower position. As the locking sleeve 321 moves longitudinally downwards relative to the drive stem 311, the one or more load plates 324 of the lock sleeve 321 engage the locking clamps 327. The flange 325 of the lock sleeve 321 may engage the locking clamps 327. The turning profile 327*b* of the locking clamps 327 may be configured to rotate against the load profile 316*s*. The flange 327*a* of the locking clamps 327 engages the load shoulder 332*s*. The locking clamps 327 support the weight of the adapter 330 and the tool. The lock sleeve 321 retains the locking clamps 327 in the locked position through the engagement with the load plates 324.

In one or more of the embodiments described herein, a method for coupling a top drive to a tool includes moving the tool adjacent to the top drive, the top drive including a drive stem having a key movable to an extended position and the tool including an adapter having a key recess configured to receive the key in the extended position, inserting the drive stem into the adapter, and biasing the key towards the extended position to couple'the drive stem and the adapter.

In one or more of the embodiments described herein, the method further includes operating an actuator to move the key to a retracted position.

In one or more of the embodiments described herein, the method further includes transferring at least one of power, data, electronics, hydraulics, and pneumatics between the drive stem and the adapter In one or more of the embodiments described herein, wherein biasing the key towards the extended position further comprises moving the key pivotally relative to the drive stem.

In one or more of the embodiments described herein, moving the key to a retracted position to decouple the drive stem and the adapter.

In one or more of the embodiments described herein, wherein moving the key to a retracted, position further comprises operating an actuator coupled to the key and engaging the drive stem with a rod of the actuator.

In one or more of the embodiments described herein, wherein moving the key to a retracted position comprises operating an actuator coupled to the drive stem and engaging the key with a rod of the actuator.

In one or more of the embodiments described herein, a coupling system for a top drive and a tool includes a drive stem of the top drive configured to transfer torque to the tool, a key disposed on the drive stem and movable to an extended position, an adapter of the tool configured to receive the drive stem, a key recess disposed on the adapter and configured to receive the key in the extended position, and a biasing member configured to bias the key towards the extended position.

In one or more of the embodiments described herein, the adapter further comprises a bore having a stepped profile.

In one or more of the embodiments described herein, an actuator configured to move the key between the extended position and the retracted position.

In one or more of the embodiments described herein, the actuator is a piston and cylinder assembly.

In one or more of the embodiments described herein, the actuator is coupled to the key.

In one or more of the embodiments described herein, the actuator is operable to engage the drive stem.

In one or more of the embodiments described herein, the actuator is coupled to the drive stem.

In one or more of the embodiments described herein, the actuator is operable to engage the key.

In one or more of the embodiments described herein, the actuator is a threaded body cylinder.

In one or more of the embodiments described herein, the coupling system includes a seal disposed about the drive stem and configured to engage the adapter.

In one or more of the embodiments described herein, the coupling system includes one or more utility couplers configured to transfer at least one of power, data, electronics, pneumatics, and hydraulics between the adapter and the drive stem.

In one or more of the embodiments described herein, the coupling system includes an alignment key disposed on the drive stem and a recess disposed in the adapter configured to receive the alignment key.

In one or more of the embodiments described herein, the alignment key is configured to align the key and the key recess.

While the foregoing is directed to embodiments of the present invention, other and further embodiments of the invention may be devised without, departing from the basic scope thereof, and the scope thereof is determined by the claims that follow.

The invention claimed is:

1. A method for coupling a top drive to a tool, comprising: moving the tool adjacent to the top drive, the top drive including a drive stem having a key movable to an extended position and the tool including an adapter having a key recess configured to receive the key in the extended position;

telescopically extending a rod of an actuator to pivot the key to a retracted position: inserting the drive stem into the adapter; and biasing the key towards the extended position to couple the drive stem and the adapter.

2. The method of claim 1, further comprising transferring at least one of power, data, electronics, hydraulics, and pneumatics between the drive stem and the adapter.

3. The method of claim 1, wherein biasing the key towards the extended position further comprises moving the key pivotally relative to the drive stem.

4. The method of claim 1, further comprising moving the key to the retracted position to decouple the drive stem and the adapter.

5. The method of claim 4, wherein moving the key to the retracted position further comprises:

operating the actuator coupled to the key; and engaging the drive stem with the rod of the actuator.

6. The method of claim 4, wherein moving the key to a retracted position comprises:

operating an actuator coupled to the drive stem; and engaging the key with a rod of the actuator.

7. A coupling system for a top drive and a tool, comprising:

a drive stem of the top drive configured to transfer torque to the tool;

a key disposed on the drive stem;

an actuator configured to move the key between an extended position and a retracted position, wherein the actuator comprises a piston and cylinder assembly;

an adapter of the tool configured to receive the drive stem;

a key recess disposed on the adapter and configured to receive the key in the extended position; and a biasing member configured to bias the key towards the extended position.

8. The coupling system of claim 7, wherein the adapter further comprises a bore having a stepped profile.

9. The coupling system of claim 7, wherein the actuator is coupled to the key.

10. The coupling system of claim 9, wherein the actuator is operable to engage the drive stem to pivot the key to the retracted position.

11. The coupling system of claim 7, wherein the actuator is coupled to the drive stem.

12. The coupling system of claim 11, wherein the actuator is operable to engage the key.

13. The coupling system of claim 7, wherein the actuator is a threaded body cylinder.

14. The coupling system of claim 7, further comprising a seal disposed about the drive stem and configured to engage the adapter.

15. The coupling system of claim 7, further comprising one or more utility couplers configured to transfer at least one of power, data, electronics, pneumatics, and hydraulics between the adapter and the drive stem.

16. The coupling system of claim 7, further comprising:

an alignment key disposed on the drive stem; and a recess disposed in the adapter configured to receive the alignment key.

17. The coupling system of claim 16, wherein the alignment key is configured to align the key and the key recess.

18. A coupling system for a top drive and a tool, comprising:

a drive stem of the top drive configured to transfer torque to the tool;

a key disposed on the drive stem and movable to an extended position;

an adapter of the tool configured to receive the drive stem;

a key recess disposed on the adapter and configured to receive the key in the extended position;

a biasing member configured to bias the key towards the extended position; and a seal disposed about the drive stem and configured to engage the adapter.

19. The coupling system of claim 18, further comprising a piston and cylinder assembly configured to pivot the key between an extended position and a retracted position.

20. The coupling system of claim 19, wherein a rod of the piston and cylinder assembly is extended to pivot the key to the retracted position.

* * * * *